US011287757B2

(12) United States Patent
Nakajima et al.

(10) Patent No.: US 11,287,757 B2
(45) Date of Patent: Mar. 29, 2022

(54) TONER, TONER STORED CONTAINER, DEVELOPER, DEVELOPING DEVICE, PROCESS CARTRIDGE, AND IMAGE FORMING APPARATUS

(71) Applicant: RICOH COMPANY, LTD., Tokyo (JP)

(72) Inventors: Hisashi Nakajima, Shizuoka (JP); Akihiro Kaneko, Shizuoka (JP); Yoshitaka Yamauchi, Shizuoka (JP); Katsunori Kurose, Shizuoka (JP); Hyo Shu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/855,564

(22) Filed: Apr. 22, 2020

(65) Prior Publication Data

US 2020/0363743 A1 Nov. 19, 2020

(30) Foreign Application Priority Data

May 14, 2019 (JP) ..... JP2019-091192

(51) Int. Cl.
*G03G 9/097* (2006.01)
*G03G 9/08* (2006.01)

(52) U.S. Cl.
CPC ..... *G03G 9/0827* (2013.01); *G03G 9/0819* (2013.01); *G03G 9/0821* (2013.01)

(58) Field of Classification Search
CPC ..... G03G 9/09708; G03G 9/09725; G03G 9/08782
See application file for complete search history.

(56) References Cited

U.S. PATENT DOCUMENTS

| | | | | |
|---|---|---|---|---|
| 4,333,842 | A | 6/1982 | Yukio et al. | |
| 2010/0196817 | A1* | 8/2010 | Sasaki | G03G 9/0819 430/109.4 |
| 2011/0065033 | A1* | 3/2011 | Uchinokura | G03G 9/0819 430/48 |
| 2017/0060011 | A1* | 3/2017 | Nakagawa | G03G 9/08711 |
| 2020/0026210 | A1 | 1/2020 | Hirai et al. | |

FOREIGN PATENT DOCUMENTS

| | | | | |
|---|---|---|---|---|
| EP | 2 192 448 A1 | | 6/2010 | |
| EP | 2192448 | * | 6/2010 | G03G 9/081 |
| EP | 2 818 932 A1 | | 12/2014 | |
| EP | 3 435 165 A1 | | 1/2019 | |

(Continued)

OTHER PUBLICATIONS

Extended European Search Report dated Sep. 21, 2020 in corresponding European Patent Application No. 20171045.6 citing documents AA, AO-AQ therein, 7 pages.

(Continued)

*Primary Examiner* — Peter L Vajda
(74) *Attorney, Agent, or Firm* — Grüneberg and Myers PLLC

(57) ABSTRACT

A toner including a strontium titanate powdery material as an external additive, the strontium titanate powdery material including Si-containing particles on a surface of the strontium titanate powdery material, the Si-containing particles having a number average circle equivalent diameter of 5 nm or more but 15 nm or less.

17 Claims, 5 Drawing Sheets

(56) References Cited

FOREIGN PATENT DOCUMENTS

| | | |
|---|---|---|
| JP | 2003-021927 | 1/2003 |
| JP | 2005-070187 | 3/2005 |
| JP | 2006-258901 | 9/2006 |
| JP | 2009-063616 | 3/2009 |
| JP | 2010-211245 | 9/2010 |
| JP | 2015-028601 | 2/2015 |
| JP | 2018-020919 | 2/2018 |
| JP | 2018-141956 | 9/2018 |
| WO | WO2009/031551 A1 | 3/2009 |

OTHER PUBLICATIONS

U.S. Appl. No. 16/695,273, filed Nov. 26, 2019 Namie Suzuki, et al.

* cited by examiner

TONER, TONER STORED CONTAINER, DEVELOPER, DEVELOPING DEVICE, PROCESS CARTRIDGE, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2019-091192, filed on May 14, 2019, in the Japan Patent Office, the entire disclosure of which is hereby incorporated by reference herein.

BACKGROUND

Technical Field

The present disclosure relates to a toner, a toner stored container, a developer, a developing device, a process cartridge, and an image forming apparatus.

Description of the Related Art

An electrophotographic image forming method includes: a charging step of giving, through electric discharge, electric charges onto the surface of a photoconductor that is a latent image bearer; an exposing step of exposing the charged surface of the photoconductor to form an electrostatic latent image; a developing step of supplying a toner to develop the electrostatic latent image formed on the surface of the photoconductor; a transfer step of transferring a toner image from the surface of the photoconductor onto a recording medium; and a fixing step of fixing the toner image on the recording medium.

SUMMARY

According to one aspect of the present disclosure, a toner includes a strontium titanate powdery material as an external additive. The strontium titanate powdery material includes Si-containing particles on a surface of the strontium titanate powdery material. The Si-containing particles have a number average circle equivalent diameter of 5 nm or more but 15 nm or less.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
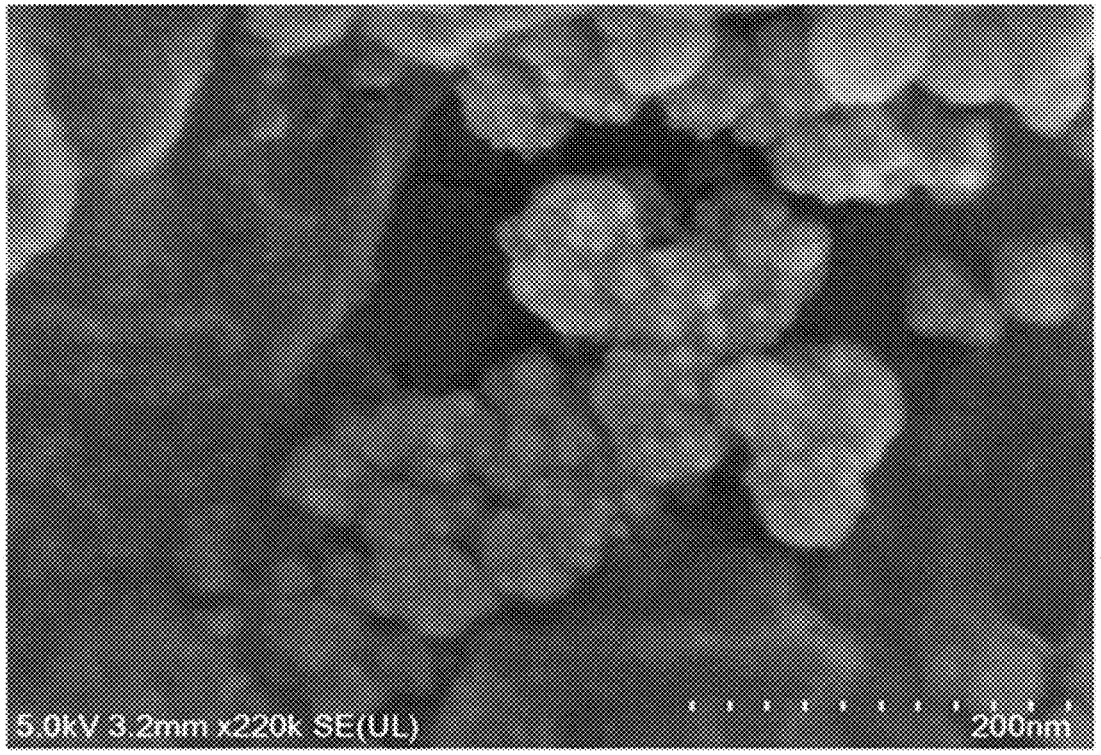
FIG. 1 is a photograph of a toner to which strontium titanate powdery material A produced in Examples described below has been externally added.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

According to the present disclosure, it is possible to provide a toner that can prevent formation of a fogged image over time in a low-temperature, low-humidity environment (temperature: 10° C. and humidity: 15% RH) to realize an excellent image density, and can prevent abrasion of a photoconductor.

(Toner)

A toner of the present disclosure includes a strontium titanate powdery material as an external additive on surfaces of toner base particles. The strontium titanate powdery material includes Si-containing particles on a surface of the strontium titanate powdery material. The Si-containing particles have a number average circle equivalent diameter of 5 nm or more but 15 nm or less. The toner of the present disclosure further includes other particles, if necessary.

Some existing toners include, as an external additive, strontium titanate powdery material that is favorable in dispersibility, environmental characteristics, and fluidity. However, consideration is not given to influences of the strontium titanate powdery material on: characteristic values of resultant toners; image quality due to formation of a fogged image over time; abrasion of a photoconductor; and quality of an image formed by an image forming apparatus including the resultant toners. Such existing toners cannot prevent formation of a fogged image over time in a low-temperature, low-humidity environment (temperature: 10° C. and humidity: 15% RH), where charging rising property of a toner tends to decrease, to realize an excellent image density. Nor can they prevent abrasion of a photoconductor.

As a result of extensive studies conducted by the present inventors, they have found that when a strontium titanate powdery material including, on a surface thereof, Si-containing particles having a number average circle equivalent diameter of 5 nm or more but 15 nm or less is used as an external additive for a toner, negative chargeability of the strontium titanate powdery material as an external additive is increased and weakly-charged or positively-charged toner particles are decreased, leading to favorable charge rising property of the toner. This makes it possible to prevent formation of a fogged image over time in a low-temperature, low-humidity environment (temperature: 10° C. and humidity: 15% RH) where charging rising property of a toner tends to decrease, to realize an excellent image density.

<Si-Containing Particles>

Examples of the Si-containing particles include, but are not limited to, sodium silicate and silica.

The Si-containing particles exist on the surface of the strontium titanate powdery material.

Existence of the Si-containing particles on the surface of the strontium titanate powdery material can be confirmed through measurement using a scanning electron microscope-energy dispersive X-ray spectroscopy (SEM-EDS) apparatus.

The number average circle equivalent diameter of the Si-containing particles is 5 nm or more but 15 nm or less, preferably 7 nm or more but 13 nm or less, more preferably 8 nm or more but 10 nm or less. When the number average circle equivalent diameter is 5 nm or more, dispersibility of the strontium titanate powdery material in the toner and charge rising property of the toner are both improved, and formation of a fogged image can be prevented. When the number average circle equivalent diameter is 15 nm or less, the Si-containing particles are not easily detached from the surface of the strontium titanate powdery material, and spent (adhesion) onto a carrier over time can be prevented. Furthermore, reduction of friction between the toner and the carrier can improve the charge rising property, and formation of a fogged image over time can be prevented in a low-temperature, low-humidity environment (temperature: 10° C. and humidity: 15% RH).

The number average circle equivalent diameter of the Si-containing particles can be determined in the following manner, for example. Specifically, the toner is observed using a scanning electron microscope (SEM) and 130 particles of the Si-containing particles are randomly selected from the observed toner image. The toner image is binarized using image processing software to calculate circle equivalent diameters of the 130 randomly-selected Si-containing particles. The circle equivalent diameters of the 130 randomly-selected Si-containing particles are averaged to determine the number average circle equivalent diameter of the Si-containing particles.

<Strontium Titanate Powdery Material>

The strontium titanate powdery material includes the Si-containing particles on the surface thereof, the Si-containing particles having a number average circle equivalent diameter of 5 nm or more but 15 nm or less.

The present inventors focused on strontium titanate, and have studied how to allow the strontium titanate to have such particle diameter and shape that exhibit excellent dispersibility as an external additive for a toner and are optimum as a fluidizing agent having favorable negative chargeability. As a result, the present inventors have found that adding Si as the third component to synthesis reaction of the strontium titanate powdery material by the normal-temperature wet method can produce a strontium titanate powdery material that includes, on a surface thereof, Si-containing particles having a number average circle equivalent diameter of 5 nm or more but 15 nm or less, the strontium titanate powdery material being favorable in dispersibility, fluidity, and negative chargeability.

The shape of the strontium titanate powdery material is preferably a particulate shape. The particulate shape is not particularly limited and may be appropriately selected depending on the intended purpose. Examples of the shape include, but are not limited to, spherical shapes, acicular shapes, and non-spherical shapes.

The structure of the strontium titanate powdery material is not particularly limited and may be appropriately selected depending on the intended purpose. For example, the structure of the strontium titanate powdery material may be a structure formed of a single particle or may be a structure formed of two or more aggregated spherical particles.

The number average circle equivalent diameter of primary particles of the strontium titanate powdery material is not particularly limited and may be appropriately selected depending on the intended purpose. The number average circle equivalent diameter of the primary particles of the strontium titanate powdery material is preferably 20 nm or more but nm or less. When the number average circle equivalent diameter is 20 nm or more, the amount of the Si-containing particles on the surface of the strontium titanate powdery material is increased. As a result, the charge rising property of the toner is improved, and the formation of a fogged image over time in a low-temperature, low-humidity environment (temperature: 10° C. and humidity: 15% RH) can be prevented. When the number average circle equivalent diameter is 40 nm or less, abradability of the strontium titanate powdery material is decreased, and abrasion on the surface of the carrier over time can be prevented. As a result, the charge rising property of the toner can be improved, and the formation of a fogged image over time in a low-temperature, low-humidity environment (temperature: 10° C. and humidity: 15% RH) can be prevented.

The number average circle equivalent diameter of the primary particles of the strontium titanate powdery material can be determined in the following manner, for example. Specifically, the toner is observed using a scanning electron microscope (SEM) and 130 primary particles of the strontium titanate powdery material are randomly selected from the observed toner image. The toner image is binarized using image processing software to calculate circle equivalent diameters of the 130 randomly-selected primary particles. The circle equivalent diameters of the 130 randomly-selected primary particles of the strontium titanate powdery material are averaged to determine the number average circle equivalent diameter of the primary particles of the strontium titanate powdery material.

The molar ratio (Si/Ti) of Si to Ti in the strontium titanate powdery material is preferably 1.0 or more but 10.0 or less, more preferably 2.0 or more but 9.0 or less, still more preferably 3.0 or more but 7.0 or less, particularly preferably 4.0 or more but 6.0 or less. When the molar ratio (Si/Ti) is 1.0 or more, the charge rising property of the toner is improved, and the formation of a fogged image can be prevented. When the molar ratio (Si/Ti) is 10.0 or less, the Si-containing particles are not easily detached from the surface of the strontium titanate powdery material, and spent (adhesion) onto a carrier over time can be prevented. In addition, the charge rising property of the toner is improved, and the formation of a fogged image can be prevented.

The molar ratio (Si/Ti) can be measured, for example, using X-ray analysis of SEM-EDS, from the peak intensity of Si to the peak intensity of Ti in the strontium titanate powdery material, with the peak intensity of carbon being a standard.

The BET specific surface area of the strontium titanate powdery material is not particularly limited and may be appropriately selected depending on the intended purpose. The BET specific surface area of the strontium titanate powdery material is preferably 50 $m^2/g$ or more. When the BET specific surface area is 50 $m^2/g$ or more, abradability of the strontium titanate powdery material is decreased, and abrasion on the surface of the carrier over time can be decreased. Therefore, the charge rising property of the toner can be improved, and the formation of a fogged image can be prevented.

The BET specific surface area can be measured by using, for example, GEMINI 2375 (obtained from MICROMETORICS INSTRUMENT CO.).

The amount of the strontium titanate powdery material is preferably 0.4 parts by mass or more but 4.0 parts by mass or less, more preferably 1.0 part by mass or more but 2.2 parts by mass or less, relative to 100 parts by mass of toner base particles. When the amount of the strontium titanate powdery material is 0.4 parts by mass or more, fluidity and aggregability of the toner can be sufficiently improved, image quality of a halftone image can be improved, and an image having voids due to aggregation of toner particles can be prevented. When the amount of the strontium titanate powdery material is 4.0 parts by mass or less, the minimum fixable temperature of the toner is increased to better the low-temperature fixability.

A method for producing the strontium titanate powdery material is, for example, the normal-temperature wet method.

The normal-temperature wet method is as follows. Specifically, a peptized product of mineral acid that is a titanium compound hydrolysate as a source of Ti and a water-soluble compound as a source of Sr are mixed to obtain a mixture. Subsequently, the mixture is allowed to react by the addition of an alkali aqueous solution (at a temperature that is 50° C. or higher but is equal to or lower than the boiling point thereof) to synthesize the strontium titanate powdery material.

The peptized product of mineral acid is not particularly limited and may be appropriately selected depending on the intended purpose. Examples of the peptized product of mineral acid include, but are not limited to, metatitanic acid.

The water-soluble compound is not particularly limited and may be appropriately selected depending on the intended purpose. Examples of the water-soluble compound include, but are not limited to, strontium chloride, strontium nitrate, and strontium hydroxide.

The alkali aqueous solution is not particularly limited and may be appropriately selected depending on the intended purpose as long as the alkali aqueous solution contains an alkali metal hydroxide. The alkali aqueous solution preferably contains sodium hydroxide.

A method for disposing Si-containing particles on the surface of the strontium titanate powdery material is as follows. Specifically, in the production of the strontium titanate powdery material by the normal-temperature wet method, a peptized product of mineral acid and a water-soluble compound are mixed, followed by further mixing with a material for Si-containing particles, to dispose the Si-containing particles on the surface of the strontium titanate powdery material.

Examples of the material for Si-containing particles include, but are not limited to, sodium silicate and silica.

—Other Particles—

The other particles are not particularly limited and may be appropriately selected depending on the intended purpose as long as the other particles are inorganic particles other than the strontium titanate powdery material. Examples of the other particles include, but are not limited to, silica, titanium oxide, barium titanate, magnesium titanate, calcium titanate, alumina, iron oxide, copper oxide, zinc oxide, tin oxide, silica sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride. These may be used alone or in combination.

The other inorganic particles may be subjected to a surface treatment using a surface treatment agent in order to increase hydrophobicity of the surface and prevent decreases in chargeability and fluidity even in a high-humidity environment.

Examples of the surface treatment agent include, but are not limited to, alkylsilane coupling agents, fluorine-containing silane coupling agents, silylating agents, silane coupling agents having a fluorinated alkyl group, organic titanate-based coupling agents, aluminum-based coupling agents, silicone oil, and modified silicone oil.

The amount of the other particles is preferably 0.4 parts by mass or more but 4.0 parts by mass or less, more preferably 1.0 part by mass or more but 2.2 parts by mass or less, relative to 100 parts by mass of toner base particles. When the amount of the other particles is 0.4 parts by mass or more, fluidity and aggregability of the toner can be sufficiently improved, image quality of a halftone image can be improved, and an image having voids due to aggregation of toner particles is not formed. When the amount of the other particles is 4.0 parts by mass or less, the minimum fixable temperature is increased to better the low-temperature fixability.

<Toner Base Particles>

The toner base particles preferably include a resin, a release agent, and a wax dispersant, and further include other components, if necessary.

The volume average particle diameter (Dv) of the toner base particles is not particularly limited and may be appropriately selected depending on the intended purpose. The volume average particle diameter (Dv) of the toner base particles is preferably 3.0 μm or more but 8.0 μm or less. When the volume average particle diameter (Dv) is 3.0 μm or more, the toner can be prevented from fusing to components such as a developing roller or a blade in use as a one-component developer. In use as a two-component developer, a decrease in chargeability of a carrier caused by fusion of the toner on the carrier surface can be prevented. When the volume average particle diameter (Dv) is 8.0 μm or less, a high-quality image can be obtained with high resolution.

The particle diameter distribution of the toner base particles is not particularly limited and may be appropriately selected depending on the intended purpose. The particle diameter distribution of the toner base particles is preferably such that particles having a volume average particle diameter (Dv) of 5.0 μm or less are 20% by number or more but 40% by number or less.

The shape of the toner base particles is preferably a particulate shape. Examples of the particulate shape include, but are not limited to, spherical shapes, acicular shapes, and non-spherical shapes obtained by uniting several spherical particles.

The circularity of the toner base particles is not particularly limited and may be appropriately selected depending on the intended purpose. The circularity is preferably 0.92 or more but 0.98 or less.

The structure of the toner base particles is not particularly limited and may be appropriately selected depending on the intended purpose. Examples of the structure include, but are not limited to, a monolithic structure and a core-shell structure.

—Resin—

The resin is not particularly limited and may be appropriately selected depending on the intended purpose as long as the resin can be obtained through polycondensation reaction or addition polymerization reaction. Examples of the resin include, but are not limited to: resins obtained through polycondensation reaction such as polyester resins, polyamide resins, and polyester-polyamide resins; and resins obtained through addition polymerization reaction such as styrene-acrylic resins and styrene-butadiene resins. These may be used alone or in combination.

The polyester resin is a resin obtained through polycondensation of a multivalent hydroxy compound and polybasic acid.

Examples of the multivalent hydroxy compound include, but are not limited to: glycols such as ethylene glycol, diethylene glycol, triethylene glycol, and propylene glycol; alicyclic compounds including two hydroxyl groups such as 1,4-bis(hydroxymethyl)-cyclohexane; and divalent phenol compounds such as bisphenol A. Note that, the multivalent hydroxy compound also includes compounds having three or more hydroxyl groups.

Examples of the polybasic acid include, but are not limited to: dicarboxylic acids such as maleic acid, fumaric acid, phthalic acid, isophthalic acid, terephthalic acid, succinic acid, and malonic acid; and multivalent carboxylic acids that are trivalent or higher valent, such as 1,2,4-benzene tricarboxylic acid, 1,2,5-benzene tricarboxylic acid, 1,2,4-cyclohexane tricarboxylic acid, 1,2,4-naphthalene tricarboxylic acid, 1,2,5-hexane tricarboxylic acid, 1,3-dicarboxyl-2-methylenecarboxypropane, and 1,2,7,8-octanetetracarboxylic acid. These may be used alone or in combination.

Examples of the monomer that is to constitute the amide component of the polyimide resin and the polyester-polyamide resin include, but are not limited to, polyamines such as ethylenediamine, pentamethylenediamine, hexamethylenediamine, phenylenediamine, and triethylenetetramine; and aminocarboxylic acids such as 6-aminocaproic acid and ε-caprolactam. These may be used alone or in combination.

The glass transition temperature (Tg) of the resin obtained through polycondensation reaction is preferably 55° C. or higher, more preferably 57° C. or higher, in terms of heat resistant storage ability.

The resin obtained through addition polymerization reaction is not particularly limited and may be appropriately selected depending on the intended purpose. Specific examples of the resin obtained through addition polymerization reaction include, but are not limited to, vinyl-based resins obtained through radical polymerization.

Examples of the raw material monomer of the resin obtained through addition polymerization reaction include, but are not limited to: styrene, o-methylstyrene, m-methylstyrene, p-methyl styrene, α-methylstyrene, p-ethyl styrene, and vinylnaphthalene; ethylenically unsaturated monoolefins such as ethylene, propylene, butylene, and isobutylene; vinyl esters such as vinyl chloride, vinyl bromide, vinyl acetate, and vinyl formate; ethylenically monocarboxylic acids and esters thereof, such as acrylic acid, methyl acrylate, ethyl acrylate, n-propyl acrylate, isopropyl acrylate, tert-butyl acrylate, amyl acrylate, methacrylic acid, methyl methacrylate, ethyl methacrylate, n-propyl methacrylate, isopropyl methacrylate, tert-butyl methacrylate, amyl methacrylate, stearyl methacrylate, methoxyethyl methacrylate, glycidyl methacrylate, phenyl methacrylate, dimethylaminoethyl methacrylate, and diethylaminoethyl methacrylate; ethylenically monocarboxylic acid substituted products such as acrylonitrile, methacrylonitrile, and acrylic amide; ethylenically dicarboxylic acid or substituted products thereof such as dimethyl maleate; and vinyl ketones such as methyl vinyl ketone. These may be used alone or in combination.

If necessary, a cross-linking agent may be added to the raw material monomer of the resin obtained through addition polymerization reaction.

The cross-linking agent is not particularly limited and may be appropriately selected depending on the intended purpose. Examples of the cross-linking agent include, but are not limited to, divinylbenzene, divinylnaphthalene, polyethylene glycol dimethacrylate, diethylene glycol dimethacrylate, triethylene glycol diacrylate, dipropylene glycol dimethacrylate, polypropylene glycol dimethacrylate, and diallyl phthalate. These may be used alone or in combination.

The amount of the cross-linking agent is preferably 0.05 parts by mass or more but parts by mass or less, more preferably 0.1 parts by mass or more but 10 parts by mass or less, relative to 100 parts by mass of the raw material monomer. When the amount of the cross-linking agent is 0.05 parts by mass or more, the effect commensurate with the addition of the cross-linking agent can be obtained. When the amount of the cross-linking agent is 15 parts by mass or less, melting by the application of heat is facilitated, and the toner is favorably fixed at the time of fixing with heat.

When the raw material monomer of the addition polymerization-based resin is allowed to undergo polymerization, a polymerization initiator is preferably used. The polymerization initiator is not particularly limited and may be appropriately selected depending on the intended purpose. Examples of the polymerization initiator include: azo- or diazo-polymerization initiators such as 2,2'-azobis(2,4-dimethylvaleronitrile) and 2,2'-azobisisobutyronitrile; and peroxide polymerization initiators such as benzoyl peroxide, methyl ethyl ketone peroxide, and 2,4-dichlorobenzoyl peroxide. These may be used alone or in combination.

The amount of the polymerization initiator is preferably 0.05 parts by mass or more but 15 parts by mass or less, more preferably 0.5 parts by mass or more but 10 parts by mass or less, relative to 100 parts by mass of the raw material monomer.

The resin obtained through polycondensation reaction or addition polymerization reaction may be a non-linear resin having a non-linear structure or may be a linear resin having a linear structure, depending on differences of, for example, reaction raw materials. The non-linear resin means a resin substantially having a cross-linked structure. The linear resin means a resin substantially having no cross-linked structure.

In the present disclosure, both the non-linear resin and the linear resin can be used.

In the present disclosure, in order to obtain a hybrid resin including a polycondensation-based resin and an addition polymerization-based resin that are chemically bonded, a bi-reactive compound, which is reactive with the monomers of both the resins, is preferably used for polymerization.

Examples of the bi-reactive compound include, but are not limited to, fumaric acid, acrylic acid, methacrylic acid, maleic acid, and dimethyl fumarate.

The amount of the bi-reactive compound is preferably 1 part by mass or more but 25 parts by mass or less, more preferably 2 parts by mass or more but 10 parts by mass or less, relative to 100 parts by mass of the raw material monomer of the addition polymerization-based resin. When the amount of the bi-reactive compound is 1 part by mass or more, a colorant or a charging-controlling agent is dispersed better, which makes it possible to achieve high image quality. In addition, when the amount of the bi-reactive compound is 25 parts by mass or less, the resin is not galated, which is advantageous.

Regarding the hybrid resin, it is not necessary to allow polycondensation reaction and addition polymerization reaction to proceed and complete simultaneously. It is possible to allow polycondensation reaction and addition polymerization reaction to independently proceed and complete by selecting respective reaction temperatures and times. In one exemplary method, a mixture including an addition-polymerization-based raw material monomer of a vinyl-based resin and a polymerization initiator is added dropwise to and premixed with a mixture including a polycondensation-based raw material monomer of a polyester resin in a reaction vessel. First, polymerization reaction of the vinyl-based resin is completed through radical reaction. Next, the reaction temperature is increased for polycondensation reaction to complete polycondensation reaction of the polyester resin.

According to the above method, two independent reactions can be allowed to proceed in parallel in a reaction vessel, and two different resins can be effectively dispersed.

The resin may include a polyurethane resin, a silicone resin, a ketone resin, a petroleum-based resin, and a hydrogenated petroleum-based resin as long as such a resin does not deteriorate properties of the toner.

—Release Agent—

The release agent is preferably a wax, more preferably an ester wax, still more preferably a synthesized monoester wax. Examples of the wax include, but are not limited to, ester wax synthesized from a long straight chain saturated fatty acid and a long straight chain saturated alcohol. The long straight chain saturated fatty acid used is represented by General Formula $C_nH_{2n+1}COOH$, where n is preferably from about 5 through about 28. The long straight chain saturated alcohol used is represented by the General Formula $C_nH_{2n+1}OH$, where n is preferably from about 5 through about 28.

The long straight chain saturated fatty acid is not particularly limited and may be appropriately selected depending on the intended purpose. Examples of the long straight chain saturated fatty acid include, but are not limited to, capric acid, undecylic acid, lauric acid, tridecylic acid, myristic acid, pentadecylic acid, palmitic acid, heptadecanoic acid, tetradecanoic acid, stearic acid, nonadecanoic acid, aramonic acid, behenic acid, lignoceric acid, cerotic acid, heptacosanoic acid, montanic acid, and melissic acid.

Examples of the long straight chain saturated alcohol include, but are not limited to, amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol. The above-listed alcohols may have a substituent, such as a lower alkyl group, an amino group, and halogen.

Examples of the wax include, but are not limited to, wax including a carbonyl group, polyolefin wax, and long-chain hydrocarbons. These may be used alone or in combination. Among them, wax including a carbonyl group are preferable.

Examples of the wax including a carbonyl group include, but are not limited to, polyalkanoic acid esters, polyalkanol esters, polyalkanoic acid amide, polyalkylamide, and dialkyl ketone. Among them, polyalkanoic acid esters are preferable.

Examples of the polyalkanoic acid ester include, but are not limited to, carnauba wax, montan wax, trimethylolpropane tribehenate, pentaerythritol tetrabehenate, pentaerythritol di acetate dibehenate, glycerin tribehenate, and 1,18-octadecanediol di stearate.

Examples of the polyalkanol ester include, but are not limited to, tristearyl trimellitate and distearyl maleate.

Examples of the polyalkanoic acid amide include, but are not limited to, dibehenyl amide.

Examples of the polyalkylamide include, but are not limited to, tristearyl trimellitate amide.

Examples of the dialkyl ketone include, but are not limited to, distearyl ketone.

Examples of the polyolefin wax include, but are not limited to, polyethylene wax and polypropylene wax.

Examples of the long-chain hydrocarbon include, but are not limited to, paraffin wax and Sasol wax.

Regarding the ester wax, a circle equivalent diameter of the wax in a cross section of the toner of the present disclosure is preferably 0.1 μm or more but 0.5 μm or less. When the circle equivalent diameter of the wax is 0.1 μm or more, the wax is easily oozed out to the surface at the time of fixing. As a result, it is possible to increase the upper limit of a fixable temperature range (i.e., the maximum fixable temperature), to improve hot offset resistance, and to prevent formation of a fogged image. When the circle equivalent diameter of the wax is 0.5 μm or less, storage ability of the toner and filming resistance onto, for example, a photoconductor can be improved, and formation of a fogged image can be prevented. In addition, abrasion of a photoconductor can be prevented.

The circle equivalent diameter of the wax in the cross section of the toner can be measured from a SEM image of the cross section of the toner that has been stained with ruthenium.

The peak intensity ratio (W/R) is preferably 0.05 or more but 0.14 or less, where W denotes the maximum height of a characteristic peak that is considered to be derived from the release agent and R denotes the maximum height of a characteristic peak that is considered to be derived from the resin as measured by the attenuated total reflectance (ATR) method using a Fourier transform infrared (FT-IR) spectroscopy analysis measuring apparatus. When the peak intensity ratio is 0.05 or more, abrasion of a photoconductor can be prevented. When the peak intensity ratio is 0.14 or more, formation of a fogged image can be prevented.

Figure 2:
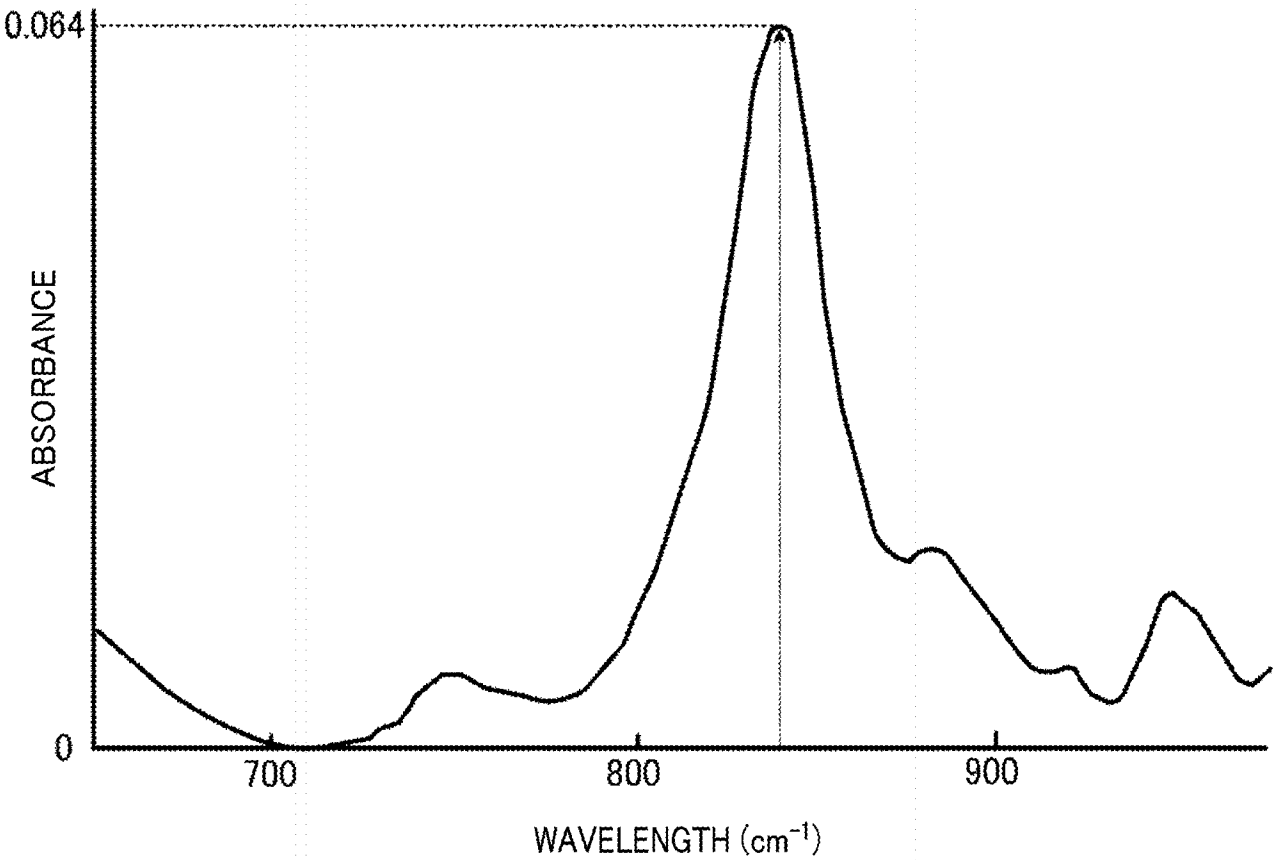
FIG. 2 is a chart presenting a characteristic spectrum of a resin contained in a toner determined by the FTIR-ATR method.

When the toner contains two or more different resins and two or more different peaks are detected, absorbance of the highest peak from a baseline of the spectrum is considered as R. For example, when the toner contains a polyester resin (the peak observed in the range of from 784 $cm^{-1}$ through 889 $cm^{-1}$; see FIG. 2) and a styrene-acrylic copolymer resin (the peak observed in the range of from 670 $cm^{-1}$ through 714 $cm^{-1}$). When absorbance of the peak observed in the range of from 784 $cm^{-1}$ through 889 $cm^{-1}$ is higher, the absorbance of the peak observed in the range of from 784 $cm^{-1}$ through 889 $cm^{-1}$ is considered as R.

The amount of the release agent is not particularly limited and may be appropriately selected depending on the intended purpose. The amount of the release agent is preferably 0.5 parts by mass or more but 20 parts by mass or less, more preferably 2 parts by mass or more but 10 parts by mass or less, relative to 100 parts by mass of the toner. When the amount of the release agent is 0.5 parts by mass or more, low-temperature fixability and hot offset resistance at the time of fixing are favorable. When the amount of the release agent is parts by mass or less, heat resistant storage ability is favorable and a high-quality image can be obtained.

—Wax Dispersant—

The wax dispersant is preferably a hybrid resin obtained by bonding a polyester resin to an addition polymerization-based resin including, as a monomer, at least one selected from the group consisting of styrene, acrylic acid, and an acrylic acid derivative. The wax dispersant contained in the toner provides the effect of dispersing the release agent. The resultant toner can be expected to be stably improved in heat resistant storage ability regardless of the production method. The effect of dispersing the release agent can prevent a filming phenomenon on the photoconductor.

The hybrid resin has a better compatibility with commonly-used release agents than the polyester resins. Therefore, dispersoids of the release agent tend to be small. In addition, the hybrid resin has a weaker internal aggregation force and has more excellent pulverizability than the polyester resin. When the release agent is dispersed at the same level, there is lower probability in the hybrid resin that the interface between the release agent and the resin will become a pulverized surface than the polyester resin, and localization of the release agent on the surface of the toner particle can be prevented, which makes it possible to increase the heat resistant storage ability of the toner.

The hybrid resin can easily have thermal characteristics similar to those of the polyester resin, and is not drastically decreased in the low-temperature fixability and the internal aggregation force that the polyester resin intrinsically has.

The amount of the wax dispersant is preferably 8 parts by mass or less relative to 100 parts by mass of the toner. When the amount of the wax dispersant is 8 parts by mass or less, dispersibility of the release agent becomes low, and filming resistance is improved. However, the wax is poorly oozed out to the surface at the time of fixing, which decreases the low-temperature fixability and the hot offset resistance.

—Other Components—

The other components are not particularly limited and may be appropriately selected depending on the intended purpose. Examples of the other components include, but are not limited to, colorants, charging-controlling agents, fluidity-improving agents, cleaning-improving agents, and magnetic materials.

—Colorant—

The colorant is not particularly limited and may be appropriately selected depending on the intended purpose. Examples of the colorant include, but are not limited to, carbon black, a nigrosine-based dye, iron black, naphthol yellow S, Hansa yellow (10G, 5G, G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), Vulcan fast yellow (5G, R), tartrazine lake, quinoline yellow lake, anthrasan yellow BGL, isoindolinon yellow, red iron oxide, red lead, lead vermilion, cadmium red, cadmium mercury red, antimony vermilion, permanent red 4R, parared, fiser red, p-chloro-o-nitro aniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine, Prussian blue, anthraquinone blue, fast violet B, methyl violet lake, cobalt violet, manganese violet, dioxane violet, antraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

The amount of the colorant is not particularly limited and may be appropriately selected depending on the intended purpose. The amount of the colorant is preferably 1 part by mass or more but 15 parts by mass or less, more preferably 3 parts by mass or more but 10 parts by mass or less, relative to 100 parts by mass of the toner.

—Charging-Controlling Agent—

The charging-controlling agent is not particularly limited and may be appropriately selected depending on the intended purpose. Examples of the charging-controlling agent include, but are not limited to, nigrosine-based dyes, triphenylmethane-based dyes, chrome-containing metal complex dyes, molybdic acid chelate pigments, rhodamine-based dyes, alkoxy-based amines, quaternary ammonium salts (including fluorine-modified quaternary ammonium salts), alkylamides, simple substances or compounds of phosphorous, simple substance or compounds of tungsten, fluorine-based activators, metal salts of salicylic acid, and metal salts of salicylic acid derivatives.

The amount of the charging-controlling agent is not particularly limited and may be appropriately selected depending on the intended purpose. The amount of the charging-controlling agent is preferably 0.1 parts by mass or more but 10 parts by mass or less, more preferably 0.2 parts by mass or more but 5 parts by mass or less, relative to 100 parts by mass of the toner. When the amount of the charging-controlling agent is 0.1 parts by mass or more, the charge rising property is improved. When the amount of the charging-controlling agent is 10 parts by mass or less, the chargeability of the toner becomes appropriate, and the effect by the addition of the charging-controlling agent is favorable, the electrostatic attraction force with a developing roller is appropriate, and the fluidity of the developer becomes favorable, which makes it possible to obtain an excellent image density. These charging-controlling agents can be melted and kneaded together with a master batch and a resin, followed by dissolution and dispersion, or may be directly added to an organic solvent for dissolution and dispersion. These charging-controlling agents may be fixed on the toner surfaces after preparation of toner particles.

—Fluidity-Improving Agent—

The fluidity-improving agent is not particularly limited and may be appropriately selected depending on the intended purpose as long as the fluidity-improving agent gives a surface treatment to increase hydrophobicity and can prevent deteriorations in fluidity or chargeability even under high-humidity conditions. Examples of the fluidity-improving agent include, but are not limited to, silane coupling agents, silylating agents, silane coupling agents having a fluorinated alkyl group, organic titanate-based coupling agents, aluminum-based coupling agents, silicone oil, and modified silicone oil. Particularly preferably, the silica and the titanium oxide are subjected to a surface treatment using the above-described fluidity-improving agent and are used as a hydrophobic silica and a hydrophobic titanium oxide, respectively.

—Cleanability-Improving Agent—

The cleanability-improving agent is not particularly limited and may be appropriately selected depending on the intended purpose as long as the cleanability-improving agent is added to the toner in order to remove a developer remaining on a photoconductor or a primary transfer medium after transfer. Examples of the cleanability-improving agent include, but are not limited to: metallic salts of fatty acids such as zinc stearate, calcium stearate, and stearic acid; and polymer particles produced through soap-free emulsion polymerization such as polymethyl methacrylate particles and polystyrene particles. The polymer particles preferably have a relatively narrow particle size distribution, and those having a volume average particle diameter of 0.01 μm or more but 1 μm or less are suitable.

—Magnetic Material—

The magnetic material is not particularly limited and may be appropriately selected depending on the intended purpose. Examples of the magnetic material include, but are not limited to, iron powder, magnetite, and ferrite. Among them, a white magnetic material is preferable in terms of color tone.

<Method for Producing Toner>

A method for producing the toner of the present disclosure is not particularly limited and may be appropriately selected depending on the intended purpose. Examples of the method for producing the toner include, but are not limited to, the pulverization method and the polymerization method.

The pulverization method will be described below. Specifically, a resin, a colorant, a release agent, and other components if necessary are mixed using a mixer, followed by kneading using a kneader such as a heat roller or an extruder. Then, the mixture is cooled and solidified, followed by pulverization using a pulverizing machine such as a jet mill. After that, the pulverized product is classified to obtain toner base particles. The obtained toner base particles and the inorganic particles are mixed to produce a toner.

Examples of the polymerization method include, but are not limited to, a bulk polymerization method, a solution polymerization method, an emulsion polymerization method, and a suspension polymerization method.

(Toner Stored Container)

A toner stored container of the present disclosure is a container in which the toner is stored.

Examples of the toner stored container include, but are not limited to, bottles and units including the bottle. The bottle can include other accessories.

When the toner stored container of the present disclosure is mounted in an image forming apparatus for image formation, it is possible to perform image formation utilizing characteristics of the toner of the present disclosure to be able to prevent formation of a fogged image over time in a low-temperature, low-humidity environment (temperature: 10° C. and humidity: 15% RH), realize an excellent image density, and prevent abrasion of a photoconductor.

Figure 6A:
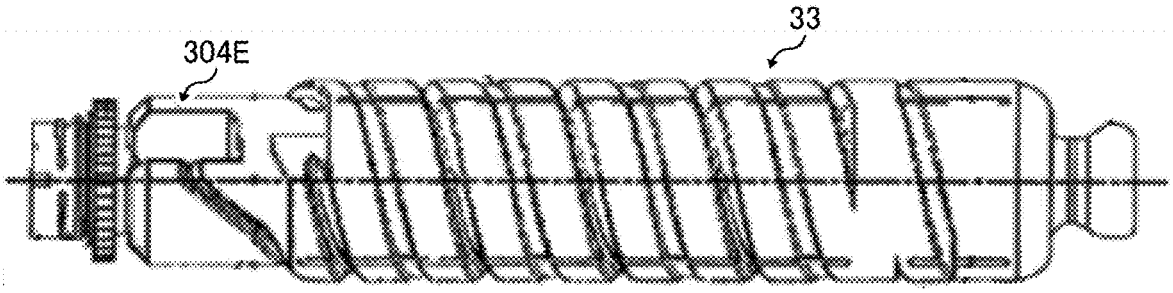
FIGS. 6A and 6B are plan and side views, respectively of a toner stored container according to an embodiment of the present invention.
Figure 6B:
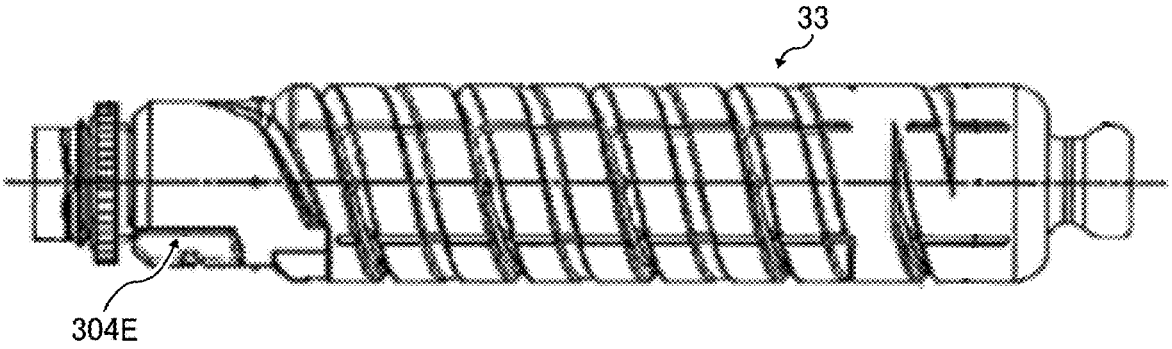

FIG. 6A is a plan view of a toner stored container 33 having a powder scooping portion 304E. FIG. 6B is a side view of the toner container 33 having the powder scooping portion 304E.

(Developer)

A developer of the present disclosure includes the toner of the present disclosure and a carrier.

The carrier is not particularly limited and may be appropriately selected depending on the intended purpose. However, a carrier including a core material and a resin layer coating the core material is preferable.

A material of the core material is not particularly limited and may be appropriately selected from known materials. For example, manganese-strontium (Mn—Sr)-based materials and manganese-magnesium (Mn—Mg)-based materials of 50 emu/g or more but 90 emu/g or less are preferable. In terms of ensuring image density, highly magnetized materials such as iron powder (100 emu/g or more) and magnetite (75 emu/g or more but 120 emu/g or less) are preferable. Furthermore, low magnetized materials such as copper-zinc (Cu—Zn)-based materials (from 30 emu/g through 80 emu/g) are preferable because such materials can alleviate an impact on a photoconductor where the toner is in the form of a brush, and are advantageous for making image quality high. These may be used alone or in combination.

The particle diameter of the core material is preferably 10 μm or more but 200 μm or less, more preferably 40 μm or more but 100 μm or less, in terms of an average particle diameter (volume average particle diameter ($D_{50}$)).

A material of the resin layer is not particularly limited and may be appropriately selected from known resins depending on the intended purpose. Examples of the material of the resin layer include, but are not limited to, amino-based resins, polyvinyl-based resins, polystyrene-based resins, halogenated olefin resins, polyester-based resins, polycarbonate-based resins, polyethylene resins, polyvinyl fluoride resins, polyvinylidene fluoride resins, polytrifluoroethylene resins, polyhexafluoropropylene resins, copolymers of vinylidene fluoride and acrylic monomer, copolymers of vinylidene fluoride and vinyl fluoride, fluoroterpolymers such as terpolymers of tetrafluoroethylene, vinylidene fluoride, and non-fluorinated monomer, and silicone resins. These may be used alone or in combination.

Examples of the amino-based resin include, but are not limited to, urea-formaldehyde resins, melamine resins, benzoguanamine resins, urea resins, polyamide resins, and epoxy resins. Examples of the polyvinyl-based resin include, but are not limited to, acrylic resins, polymethyl methacrylate resins, polyacrylonitrile resins, polyvinyl acetate resins, polyvinyl alcohol resins, and polyvinyl butyral resins. Examples of the polystyrene-based resin include, but are not limited to, polystyrene resins and styrene-acrylic copolymer resins. Examples of the halogenated olefin resins include, but are not limited to, polyvinyl chloride. Examples of the polyester-based resins include, but are not limited to, polyethylene terephthalate resins and polybutylene terephthalate resins.

The resin layer may include, for example, conductive powder, if necessary. Examples of the conductive powder include, but are not limited to, metal powder, carbon black, titanium oxide, tin oxide, and zinc oxide. The conductive powder preferably has an average particle diameter of 1 μm or less. The conductive powder having an average particle diameter of 1 μm or less can easily control electric resistance.

The resin layer can be formed in the following manner. Specifically, for example, the silicone resin is dissolved in a solvent to prepare a coating solution. Then, the surface of the core material is uniformly coated with the coating solution by a known coating method. The solution is dried, followed by baking to form the resin layer. Examples of the coating method include, but are not limited to, a dipping method, a spraying method, and a brush coating method.

The solvent is not particularly limited and may be appropriately selected depending on the intended purpose.

Examples of the solvent include, but are not limited to, toluene, xylene, methyl ethyl ketone, methyl isobutyl ketone, and butyl cellosolve acetate.

The baking is not particularly limited and may be an external heating system or an internal heating system. Examples of the baking include, but are not limited to, methods using a fixed-type electric furnace, a flow-type electric furnace, a rotary-type electric furnace, and a burner furnace, and methods using microwaves.

The amount of the resin layer in the carrier is preferably 0.01% by mass or more but 5.0% by mass or less. When the amount of the resin layer is 0.01% by mass or more, the resin layer can be uniformly formed on the surface of the core material. When the amount of the resin layer is 5.0% by mass or less, the thickness of the resin layer is appropriate, which makes it possible to obtain uniform carrier particles.

The amount of the carrier in the developer is not particularly limited and may be appropriately selected depending on the intended purpose. For example, the amount of the carrier in the developer is preferably 90% by mass or more but 98% by mass or less, more preferably 93% by mass or more but 97% by mass or less.

With respect to the mixing ratio between the toner and the carrier in the developer, preferably, 1 part by mass or more but 10.0 parts by mass or less of the toner is mixed with 100 parts by mass of the carrier.

The developer of the present disclosure includes the toner of the present disclosure. Therefore, formation of a fogged image over time in a low-temperature, low-humidity environment (temperature: 10° C. and humidity: 15% RH) can be prevented, an excellent image density can be realized, and abrasion of the photoconductor can be prevented.

The developer of the present disclosure can be suitably used for forming an image by various electrophotographic methods, and can be suitably used in a developing device, a process cartridge, and an image forming apparatus of the present disclosure, which will be described hereinafter.

(Developing Device)

A developing device of the present disclosure includes a developer and a developer bearer configured to bear and convey the developer.

The developer includes the developer of the present disclosure.

(Process Cartridge and Image Forming Apparatus)

A process cartridge of the present disclosure includes an electrostatic latent image bearer and a developing unit containing the developer, configured to develop, with the developer, an electrostatic latent image formed on the electrostatic latent image bearer, and further includes other appropriately selected units, if necessary.

An image forming apparatus of the present disclosure includes an electrostatic latent image bearer and a developing unit containing the developer, configured to develop, with the developer, an electrostatic latent image formed on the electrostatic latent image bearer, and further includes other appropriately selected units, if necessary.

Examples of the electrostatic latent image bearer include, but are not limited to, known photoconductors.

The developer includes the developer of the present disclosure.

The developing unit includes the developing device of the present disclosure.

The process cartridge can be detachably mounted in various electrophotographic image forming apparatuses, and are preferably detachably mounted in the image forming apparatus of the present disclosure.

Examples of the other units of the process cartridge include, but are not limited to, a charging unit, an exposure unit, and a cleaning unit.

Examples of the other units of the image forming apparatus include, but are not limited to, a charging unit, an exposure unit, a charge-eliminating unit, a transfer unit, a fixing unit, a cleaning unit, a recycling unit, and a controlling unit.

The toner of the present disclosure provides excellent effects even when the toner is loaded into an image forming apparatus including a process cartridge for image formation. That is, a process cartridge that makes image quality excellent can be provided by using the toner of the present disclosure.

Figure 3:
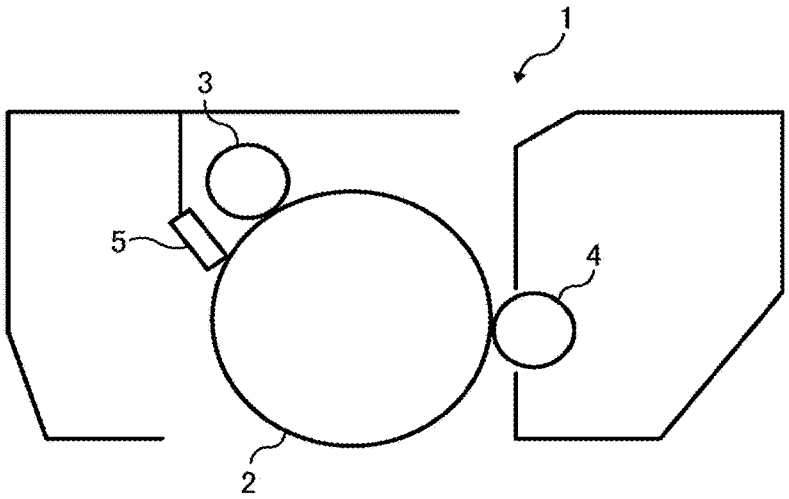
FIG. 3 is a schematic view of one example of an image forming apparatus including a process cartridge of the present disclosure.

FIG. 3 is a schematic view presenting one example of a process cartridge of the present disclosure. A process cartridge 1 of FIG. 3 includes an electrostatic latent image bearer 2, a charging unit 3, a developing unit 4, and a cleaning unit 5.

In the image forming apparatus including the process cartridge, the electrostatic latent image bearer 2 is rotated and driven at a predetermined circumferential speed.

In the rotation process, the peripheral surface of the electrostatic latent image bearer 2 is uniformly charged by the charging unit 3 to have a predetermined positive or negative electric potential. Then, the electrostatic latent image bearer 2 is exposed to image-exposing light from an exposure unit (e.g., slit exposure or laser beam scanning exposure) to sequentially form an electrostatic latent image on the peripheral surface of the electrostatic latent image bearer 2. The formed electrostatic latent image is then developed with a toner by the developing unit 4. The developed toner image is sequentially transferred by a transfer unit on a recording medium that is fed between the electrostatic latent image bearer and the transfer unit from a paper sheet feeding unit in synchronization with rotation of the electrostatic latent image bearer.

The recording medium to which the image has been transferred is separated from the surface of the electrostatic latent image bearer, and is introduced to a fixing unit for image fixing. Then, it is printed out as a copied product (copy) to the outside of an apparatus.

The cleaning unit 5 removes the toner remaining on the surface of the electrostatic latent image bearer without being transferred to clean the surface thereof, and further, electricity is removed from the surface. The electrostatic latent image bearer is repeatedly used for image formation.

Even when the toner of the present disclosure is used in an image forming apparatus including a contact-type charging device to form an image, excellent effects can be obtained. That is, use of the toner of the present disclosure makes it possible to provide an image forming apparatus using a charging device that generates a less amount of ozone.

Figure 4:
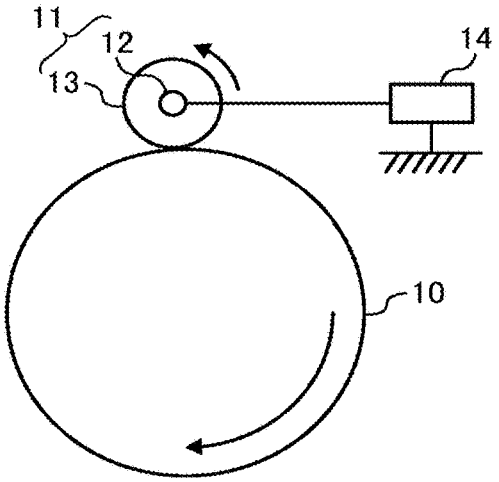
FIG. 4 is a schematic view presenting one example of an image forming apparatus including a charging device configured to perform charging with a roller.

Here, FIG. 4 is a schematic view presenting one example of an image forming apparatus including a charging device configured to perform charging with a roller.

A drum-shaped electrostatic latent image bearer 10 as a member to be charged and an image bearer is rotated and driven at a predetermined speed (process speed) in a direction indicated by an arrow in FIG. 4.

A charging roller 11 is a charging member provided in contact with the electrostatic latent image bearer 10. The charging roller 11 includes a cored bar 12 and an electric conductive rubber layer 13 as a basic structure. The electric conductive rubber layer 13 is formed on the peripheral surface of the cored bar 12 and is integrally and concentrically formed with the roller. Both ends of the cored bar 12 are rotatably supported with, for example, bearings. Moreover, the charging roller 11 is pressed by a pressurization unit against the photoconductor drum at a predetermined pressing force. In FIG. 4, the charging roller 11 is rotated by following the rotating and driving of the electrostatic latent image bearer 10.

The charging roller 11 is formed to have a diameter of 16 mm by coating the cored bar having a diameter of 9 mm with a film of the rubber layer having an intermediate resistivity of about 100,000 Ω·cm.

As presented in FIG. 4, the cored bar 12 of the charging roller 11 and a power source 14 are electrically connected, and a predetermined bias is applied to the charging roller 11 from the power source 14. As a result, the peripheral surface of the electrostatic latent image bearer 10 is uniformly charged so as to have predetermined polarity and potential.

Figure 5:
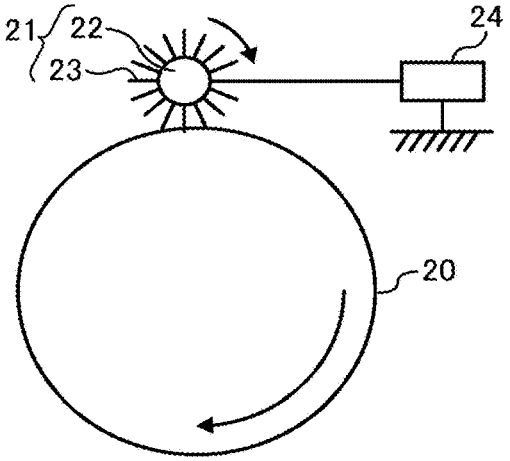
FIG. 5 is a schematic view presenting one example of an image forming apparatus including a charging device configured to perform charging with a brush.

FIG. 5 is a schematic view presenting one example of an image forming apparatus including a charging device configured to perform charging with a brush.

A drum-shaped electrostatic latent image bearer 20 as a member to be charged and an image bearer is rotated and driven at a predetermined speed (process speed) in a direction indicated by an arrow in FIG. 5.

A fur brush roller 21 is brought into contact with the electrostatic latent image bearer with a predetermined nip width being maintained at a predetermined pressing force against elasticity of a brush part 23.

The fur brush roller 21 as a contact charging member is a roll brush having an outer diameter of 14 mm and a longitudinal length of 250 mm. The fur brush roller 21 is formed by spirally winding a pile tape of conductive rayon fibers REC-B (obtained from UNITIKA LTD.) as the brush part 23, around a metallic cored bar 22 having a diameter of 6 mm and also serving as an electrode.

The brush of the brush part 23 has a density of 300 deniers/50 filaments and 155 filaments/$mm^2$.

This roll brush is inserted into a pipe having an inner diameter of 12 mm with the roll brush being rotated in one direction and the pipe being concentric with the brush. Then, the roll brush is left to stand in a high-temperature, high-humidity atmosphere to make the fibers slanted.

The resistance value of the fur brush roller 21 is $1\times10^5\Omega$ at an applied voltage of 100 V.

The resistance value is determined from electric current flowing at the time of applying voltage of 100 V to the fur brush roller 21 abutting on a metallic drum having a diameter of 30 mm with a nip width of 3 mm.

The resistance value of the fur brush charging device is preferably $10^4\Omega$ or more, in order to prevent image failure caused by poorly charged charging nip part, which is caused by allowing excessive leak current to flow into a defect portion (e.g., pin holes) with a low voltage resistance on the electrostatic latent image bearer 20 as a member to be charged. Furthermore, in order to sufficiently inject charges into the surface of the electrostatic latent image bearer, the resistance is more preferably $10^7\Omega$ or less.

Examples of the material of the brush include, but are not limited to: REC-C, REC-M1, and REC-M10 in addition to REC-B (obtained from UNITIKA LTD.); SA-7 (obtained from Toray Industries, Inc.); THUNDERON (obtained from Nihon Sanmo Dyeing Co., Ltd.); BELLTRON (obtained from Kanebo, Ltd.); KURACARB (obtained from KURARY CO., LTD.); those obtained by dispersing carbon in rayon; and ROVAL (obtained from Mitsubishi Rayon Co., Ltd.).

Preferably, each fiber of the brush is from 3 deniers through 10 deniers, and the brush has a density of from 10 filaments per bundle through 100 filaments per bundle and 80 fibers/$mm^2$ through 600 fibers/$mm^2$. The length of the fiber is preferably from 1 mm through 10 mm.

The fur brush roller 21 is rotated and driven in the opposite (counter) direction to the rotational direction of the electrostatic latent image bearer 20 at a predetermined circumferential speed (speed of the surface), and is brought into contact with the surface of the electrostatic latent image bearer with a difference in the speeds. Then, when a predetermined charging voltage is applied to the fur brush roller 21 from a power source 24, the surface of the electrostatic latent image bearer is uniformly charged in a contact manner so as to have predetermined polarity and potential.

The contact charging of the electrostatic latent image bearer 20 by the fur brush roller 21 is dominantly performed by direct injection of charges. The surface of the electrostatic latent image bearer is charged to the potential that is substantially equal to the charging voltage applied to the fur brush roller 21.

In the case of magnetic brush charging, the fur brush roller 21 formed of the magnetic brush is brought into contact with the electrostatic latent image bearer 20 with a predetermined nip width being maintained at a predetermined pressing force against elasticity of the brush part 23, similar to the above fur brush charging.

The magnetic brush as a contact charging member includes magnetic particles obtained by coating ferrite particles having an average particle diameter of 25 μm with a resin layer having an intermediate resistance. The ferrite particles are obtained by mixing Zn—Cu ferrite particles having an average particle diameter of 25 μm and Zn—Cu ferrite particles having an average particle diameter of 10 μm at a mass ratio of 1:0.05. The ferrite particles have peaks at positions of the respective average particle diameters.

The contact charging member is constituted with, for example, the coated magnetic particles prepared above, a non-magnetic electric conductive sleeve configured to support the coated magnetic particles, and a magnet roll provided inside the electric conductive sleeve. The electric conductive sleeve is coated with a layer of the coated magnetic particles having a thickness of 1 mm, and a charging nip having a width of about 5 mm is formed with respect to the electrostatic latent image bearer 20.

Moreover, a gap between the electric conductive sleeve that bears the coated magnetic particles and the electrostatic latent image bearer is about 500 μm.

Moreover, the magnet roll is rotated so that the sleeve surface slides in the opposite direction at a speed twice faster than the circumferential speed of the surface of the electrostatic latent image bearer, and that the electrostatic latent image bearer and the magnetic brush are uniformly brought into contact with each other.

Figure 7:
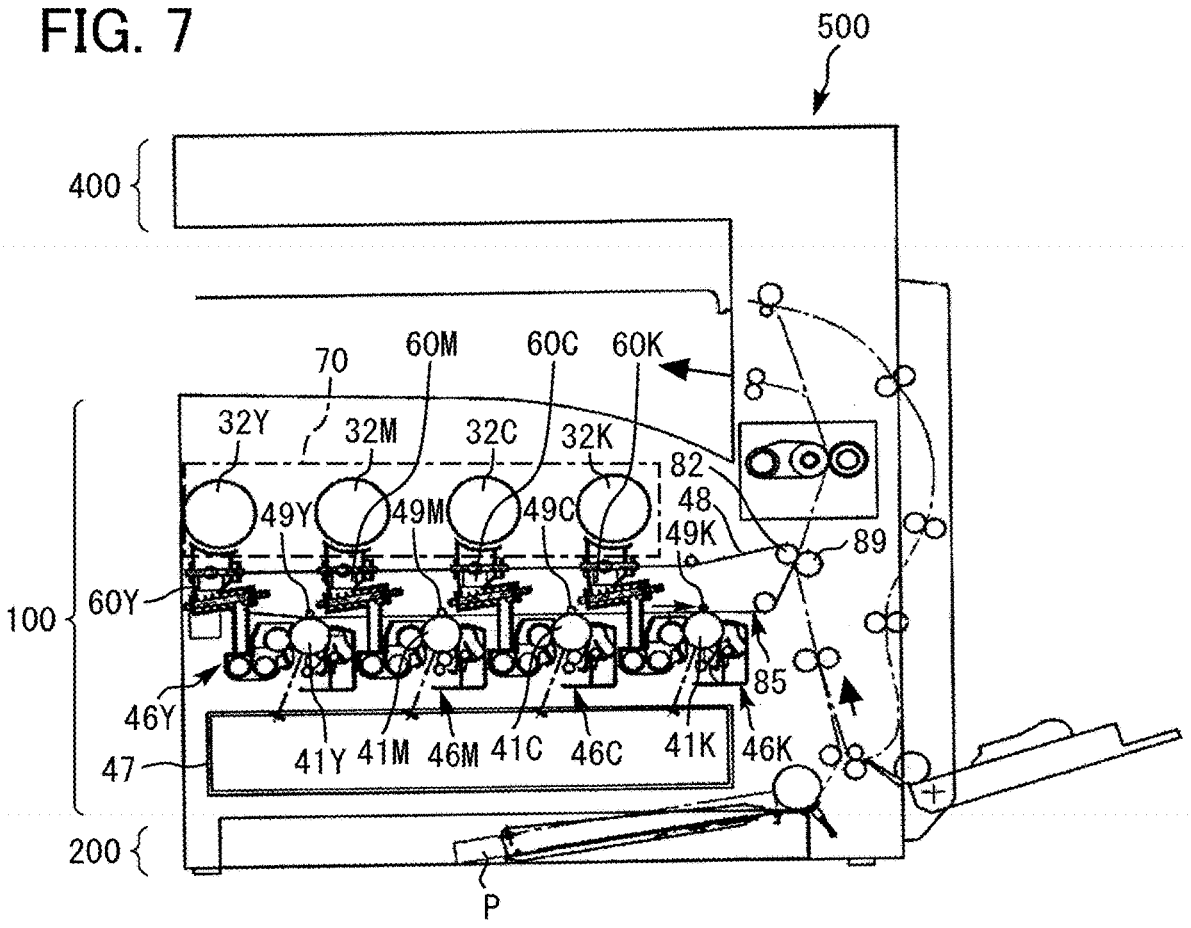
FIG. 7 is a schematic diagram illustrating an image forming apparatus according to an embodiment of the present invention.

FIG. 7 is a schematic diagram illustrating an electrophotographic tandem-type color copier (hereinafter "copier 500") as an image forming apparatus according to an embodiment of the present invention. The copier 500 may be a monochrome copier. The image forming apparatus may be, instead of the copier, a printer, a facsimile machine, or a multifunction peripheral having a plurality of functions. The copier 500 includes a copier main body (hereinafter "printer 100"), a sheet feeding table (hereinafter "sheet feeder 200"), and a document reader (hereinafter "scanner 400") disposed above the printer 100.

A toner container storage unit 70 as a powder container storage unit, provided on an upper part of the printer 100, has four toner containers 32Y, 32M, 32C, and 32K as powder containers corresponding to yellow, magenta, cyan, and black, respectively, which are installed detachably (replaceably). An intermediate transfer unit 85 is disposed below the toner container storage unit 70.

The intermediate transfer unit 85 includes an intermediate transfer belt 48 as an intermediate transferor, four primary transfer bias rollers 49Y, 49M, 49C, and 49K, a secondary transfer backup roller 82, a plurality of rollers, and an intermediate transfer cleaner. The intermediate transfer belt 48 is stretched and supported by the plurality of rollers, and is endlessly moved in a direction indicated by arrow in FIG. 7 by rotary drive of the secondary transfer backup roller 82 that is one of the plurality of rollers.

In the printer 100, four image forming units 46Y, 46M, 46C, and 46K are arranged in parallel facing the intermediate transfer belt 48. Below the four toner containers 32Y, 32M, 32C, and 32K, four toner supply devices 60Y, 60M, 60C, and 60K as four powder supply devices are respectively disposed. Toners, which are powdery developers, stored in the toner containers 32Y, 32M, 32C, and 32K are supplied to the developing devices included in the respective image forming units 46Y, 46M, 46C, and 46K by the respective toner supply devices 60Y, 60M, 60C, and 60K. In the present embodiment, the four image forming units 46Y, 46M, 46C, and 46K constitute an imaging unit.

As illustrated in FIG. 7, the printer 100 includes, below the four image forming units 46, an irradiator 47 that is a latent image forming device. The irradiator 47 irradiates and scans the surfaces of photoconductors 41Y, 41M, 41C, and 41K as image bearers based on image information of the document read by the scanner 400, to form electrostatic latent images on the surfaces of the photoconductors. The image information may be either that read by the scanner 400 or that input from an external device such as a personal computer connected to the copier 500.

In the present embodiment, the irradiator 47 employs a laser beam scanner method using a laser diode. Alternatively, the irradiator 47 may employ another system such as that using an LED (light emitting diode) arrays.

Figure 8:
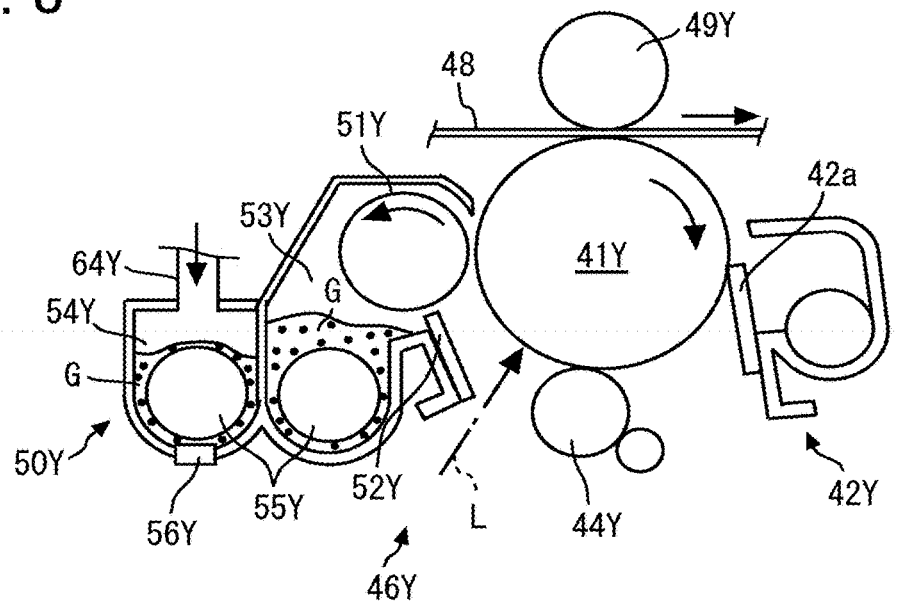
FIG. 8 is a schematic diagram illustrating an image forming unit contained in the image forming apparatus according to an embodiment of the present invention.

FIG. 8 is a schematic diagram illustrating the image forming unit 46Y corresponding to yellow.

The image forming unit 46Y includes a drum-shaped photoconductor 41Y. The image forming unit 46Y has a configuration in which a charging roller 44Y as a charger, a developing device 50Y as a developing device, a photoconductor cleaner 42Y, and a charge removing device are arranged around the photoconductor 41Y. On the photoconductor 41Y, image forming processes (i.e., charging process, irradiating process, developing process, transfer process, and cleaning process) are performed to form a yellow toner image on the photoconductor 41Y.

The other three image forming units 46M, 46C, and 46K have substantially the same configuration as the image forming unit 46Y except that the color of the toner used is different. On the photoconductors 41M, 41C, and 41K, toner images corresponding to the respective colors are formed. Hereinafter, the descriptions of the other three image forming units 46M, 46C, and 46K are omitted, and only the image forming unit 46Y is described.

The photoconductor 41Y is rotationally driven clockwise in FIG. 8 by a drive motor. The surface of the photoconductor 41Y is uniformly charged at a position where the photoconductor 41Y faces the charging roller 44Y ("charging process"). After that, the surface of the photoconductor 41Y reaches a position where the photoconductor 41Y is irradiated and scanned with a laser light beam L emitted from the irradiator 47, so that an electrostatic latent image corresponding to yellow is formed at this position ("irradiating process"). After that, the surface of the photoconductor 41Y reaches a position where the photoconductor 41Y faces the developing device 50Y, so that the electrostatic latent image is developed with yellow toner at this position to form a yellow toner image ("developing step").

In the intermediate transfer unit 85, the four primary transfer bias rollers 49Y, 49M, 49C, and 49K and the respective photoconductors 41Y, 41M, 41C, and 41K sandwich the intermediate transfer belt 48 to form respective primary transfer nips. To each of the primary transfer bias rollers 49Y, 49M, 49C, and 49K, a transfer bias is applied having a polarity opposite to that of the toner.

The surface of the photoconductor 41Y on which the toner image has been formed in the developing process reaches the primary transfer nip where the photoconductor 41Y faces the primary transfer bias roller 49Y with the intermediate transfer belt 48 interposed therebetween. At the primary transfer nip, the toner image on the photoconductor 41Y is transferred onto the intermediate transfer belt 48 ("primary transfer process"). At this time, a small amount of untransferred toner particles remains on the photoconductor 41Y. The surface of the photoconductor 41Y from which the toner image has been transferred onto the intermediate transfer belt 48 at the primary transfer nip reaches a position where the photoconductor 41Y faces the photoconductor cleaner 42Y. The untransferred toner particles remaining on the photoconductor 41Y are mechanically collected by a cleaning blade 42*a* of the photoconductor cleaner 42Y at that position ("cleaning process"). Finally, the surface of the photoconductor 41Y reaches a position where the photoconductor 41Y faces the charge removing device, and a residual potential on the photoconductor 41Y is removed at this position. Thus, a series of image forming processes performed on the photoconductor 41Y is completed.

Such image forming processes are performed in the other image forming units 46M, 46C, and 46K as in the yellow image forming unit 46Y. Specifically, the laser light beam L is emitted, based on the image information, from the irradiator 47 disposed below the image forming units 46M, 46C, and 46K to the respective photoconductors 41M, 41C, and 41K included in the respective image forming units 46M, 46C, and 46K. More specifically, in the irradiator 47, a light source emits the laser light beam L and a rotationally-driven polygon mirror scans the photoconductors 41M, 41C, and 41K with the laser beam L, so that the photoconductors 41M, 41C, and 41K are irradiated with the laser light beam L through a plurality of optical elements. After that, the toner images formed on the photoconductors 41M, 41C, and 41K through the developing process are transferred onto the intermediate transfer belt 48.

At this time, the intermediate transfer belt 48 travels in a direction indicated by arrow in FIG. 7 and sequentially passes through the primary transfer nips formed with the respective primary transfer bias rollers 49Y, 49M, 49C, and 49K. As a result, the toner images of respective colors on the photoconductors 41Y, 41M, 41C, and 41K are primarily transferred onto the intermediate transfer belt 48 in a superimposed manner, thus forming a color toner image on the intermediate transfer belt 48.

The intermediate transfer belt 48 on which the toner images of respective colors have been transferred in a superimposed manner to form the color toner image reaches a position where the intermediate transfer belt 48 faces a secondary transfer roller 89. At this position, the secondary transfer backup roller 82 and the secondary transfer roller 89 sandwich the intermediate transfer belt 48 to form a secondary transfer nip. The color toner image formed on the intermediate transfer belt 48 is then transferred onto a recording medium P, such as a transfer sheet, having been conveyed to the position of the secondary transfer nip by, for example, the action of a transfer bias applied to the secondary transfer backup roller 82. At this time, untransferred toner particles that have not been transferred onto the recording medium P remain on the intermediate transfer belt 48. The intermediate transfer belt 48 that has passed through the secondary transfer nip reaches the position of the intermediate transfer cleaner, and the untransferred toner particles on the surface thereof are collected. Thus, a series of transfer processes performed on the intermediate transfer belt 48 is completed.

Next, the configuration and operation of the developing device 50 in the image forming unit 46 are described in more detail below. Although the image forming unit 46Y corresponding to yellow is described as an example here, the image forming units 46M, 46C, and 46K corresponding to other colors also have the same configuration and operation.

As illustrated in FIG. 8, the developing device 50Y includes a developing roller 51Y as a developer bearer, a doctor blade 52Y as a developer regulating plate, two developer conveying screws 55Y, and a toner concentration detection sensor 56Y. The developing roller 51Y faces the photoconductor 41Y, and the doctor blade 52Y faces the developing roller 51Y. The two developer conveying screws 55Y are disposed in two developer accommodating units 53Y and 54Y, respectively. The developing roller 51Y is composed of a magnet roller fixed inside and a sleeve that rotates around the magnet roller. A two-component developer G composed of a carrier and a toner is accommodated in a first developer accommodating unit 53Y and a second developer accommodating unit 54Y. The second developer accommodating unit 54Y communicates with a toner drop conveyance path 64Y through an opening formed on top of the second developer accommodating unit 54Y. The toner concentration detection sensor 56Y detects the toner concentration in the developer G in the second developer accommodating unit 54Y.

The developer G in the developing device 50Y circulates between the first developer accommodating unit 53Y and the second developer accommodating unit 54Y while being stirred by the two developer conveying screws 55Y. The developer G in the first developer accommodating unit 53Y is, while being conveyed by one of the developer conveying screws 55Y, supplied to and carried on the sleeve surface of the developing roller 51Y by a magnetic field formed by the magnet roller in the developing roller 51Y. The sleeve of the developing roller 51Y is rotationally driven counterclockwise as indicated by arrow in FIG. 8, and the developer G carried on the developing roller 51Y moves on the developing roller 51Y as the sleeve rotates. At this time, the toner in the developer G is charged to a potential having a polarity opposite to that of the carrier, by triboelectric charging with the carrier, and electrostatically adsorbed to the carrier. Thus, the toner is carried on the developing roller 51Y together with the carrier attracted by the magnetic field formed on the developing roller sly.

The developer G carried on the developing roller 51Y is conveyed in a direction indicated by arrow in FIG. 8 and reaches a doctor position where the doctor blade 52Y and the developing roller 51Y face each other. The amount of the developer G on the developing roller 51Y is appropriately regulated and adjusted when the developer G passes through the doctor position. After that, the developer G on the developing roller 51Y is conveyed to a developing region that is a position where the developing roller 51Y faces the photoconductor 41Y. In the developing region, the toner in the developer G is adsorbed to a latent image formed on the photoconductor 41Y by a developing electric field formed between the developing roller 51Y and the photoconductor 41Y. The developer G remaining on the surface of the developing roller 51Y after passing through the developing region reaches above the first developer accommodating unit 53Y as the sleeve rotates, and separates from the developing roller 51Y at this position.

The developer G in the developing device 50Y is adjusted so that the toner concentration is within a predetermined range. Specifically, according to the amount of toner contained in the developer G in the developing device 50Y consumed in the developing process, the toner contained in the toner container 32Y is supplied to the second developer accommodating unit 54Y via the toner supply device 60Y. The toner supplied to the second developer accommodating unit 54Y circulates between the first developer accommodating unit 53Y and the second developer accommodating unit 54Y while being mixed and stirred with the developer G by the two developer conveying screws 55Y.

EXAMPLES

The present disclosure will be described in more detail by way of Examples. However, the present disclosure should not be construed as being limited to the following Examples.

(Synthesis of Non-Linear Polyester Resin A)

A flask equipped with a stainless stirring rod, a flow-down-type condenser, a nitrogen gas introducing tube, and a thermometer was charged with fumaric acid (9.0 mol), trimellitic anhydride (3.5 mol), bisphenol A (2,2)propylene oxide (5.5 mol), and bisphenol A (2,2)ethylene oxide (3.5 mol). Then, the mixture was allowed to undergo polycondensation reaction under stirring at 230° C. under a nitrogen gas stream, to obtain non-linear polyester resin A.

As a result of measuring a softening temperature, a glass transition temperature, and a weight average molecular weight of the non-linear polyester resin A in the following manners, the non-linear polyester resin A was found to have a softening temperature (Tm) of 145.1° C., a glass transition temperature (Tg) of 61.5° C., and a weight average molecular weight (Mw) of 82,000.

<Softening Temperature (Tm)>

A softening temperature (Tm) (° C.) was measured using a Capillary Rheometer Flowtester (CFT-500D, obtained from SHIMADZU CORPORATION) according to the JIS (Japanese Industrial Srandards) K72101. Specifically, the non-linear polyester resin A (1 $cm^3$) was heated at a heating rate of 6° C./min while a load of 20 $kg/cm^2$ was applied to the non-linear polyester resin A using a plunger and extruded from a nozzle having a diameter of 1 mm and a length of 1 mm. A curve of the plunger descending amount versus temperature was drawn. When the height of the curve (maximum value) was defined as h, a temperature corresponding to h/2 (temperature at which half of the non-linear polyester resin A flowed) was defined as a softening temperature (Tm) (° C.).

<Glass Transition Temperature (Tg)>

A glass transition temperature (Tg) was measured using a differential scanning calorimeter (DSC-60, obtained from SHIMADZU CORPORATION) according to the JIS K7121-1987. Specifically, the non-linear polyester resin A was heated from room temperature (25° C.) to 200° C. at 10° C./min, was cooled to room temperature at a cooling rate of 10° C./min, and was heated at a heating rate of 10° C./min. When the difference between the height of a baseline at a temperature equal to or lower than a glass transition temperature and the height of a baseline at a temperature equal to or higher than the glass transition temperature was defined as h, a temperature corresponding to h/2 was defined as the glass transition temperature (Tg) (° C.).

<Weight Average Molecular Weight (Mw)>

A GPC measuring apparatus (HLC-8220GPC, obtained from Tosoh Corporation) and columns (TSKgel Super-HZM-H 15 cm, triple, obtained from Tosoh Corporation) were used to measure a weight average molecular weight. Specifically, the columns were stabilized in a heat chamber of 40° C. A tetrahydrofuran (THF) solution (from 50 μL, through 200 μL) was injected into the columns at a flow rate of 1 mL/min, and the weight average molecular weight of the non-linear polyester resin A was measured. The weight average molecular weight (Mw) of the resin was calculated from a relationship between the count numbers and logarithmic values of a calibration curve prepared using several kinds of monodispersed polystyrene standard samples. An RI (refractive index) detector was used as a detector.

The monodispersed polystyrene standard samples were samples having a weight average molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ (obtained from Pressure Chemical or Tosoh Corporation).

(Synthesis of Linear Polyester Resin B)

A flask equipped with a stainless stirring rod, a flow-down-type condenser, a nitrogen gas introducing tube, and a thermometer was charged with terephthalic acid (7.0 mol), trimellitic anhydride (2.5 mol), bisphenol A (2,2) propylene oxide (5.5 mol), and bisphenol A (2,2) ethylene oxide (3.5 mol). Then, the mixture was allowed to undergo polycondensation reaction under stirring at 230° C. under a nitrogen gas stream, to obtain linear polyester resin B.

As a result of measuring a softening temperature, a glass transition temperature, and a weight average molecular weight of the obtained linear polyester resin B in the same manners as in the non-linear polyester resin A, the linear polyester resin B was found to have a softening temperature (Tm) of 102.8° C., a glass transition temperature (Tg) of 61.2° C., and a weight average molecular weight (Mw) of 8,000.

(Synthesis of Wax Dispersant)

A 5 L-autoclave with a distillation column was charged with a monomer (4,000 g) containing 45 mol % of polyoxypropylene(2.2)-2,2-bis(4-hydroxyphenyl)propane (hereinafter may be referred to as "BPA-PO") represented by the following General Formula (1) and 30 mol % of sebacic acid, and dibutyltin oxide (5 g). The monomer was allowed to undergo polycondensation at 230° C. for 6 hours under a nitrogen gas stream, followed by cooling to 160° C., and further allowed to undergo addition polymerization reaction at 160° C. for 1 hour, with a mixture of styrene (15 mol %), acrylic acid (10 mol %), and di-tert-butyl peroxide (25 g) being added to the autoclave under stirring at 160° C. for 1 hour. Then, the resultant was allowed to undergo polycondensation reaction at 180° C.

(Production of Strontium Titanate Powdery Material A)

Metatitanic acid obtained by the sulfuric acid method was subjected to a deironization and bleaching treatment. A 5N sodium hydroxide aqueous solution was added for desulfurization to 320 g of the metatitanic acid so that the pH would be 9.0. Subsequently, 2N hydrochloric acid was added to the mixture so that the pH would be 6.2, followed by filtrating and then washing with water, to obtain a washed cake. Water was added to the washed cake to obtain a slurry having an amount of $TiO_2$ of 2.1 mol/L. Subsequently, 2N hydrochloric acid was added for peptization to the slurry so that the pH would be 1.4, to obtain a peptized water-containing titanium oxide slurry ($TiO_2$: 1.88 mol).

To the peptized water-containing titanium oxide slurry, a strontium chloride solution (2.35 mol) was added so that the Ti molar ratio would be 1.25. Sodium silicate (0.15 mol) was added to the mixture so that the Ti molar ratio would be 5, to adjust the concentration of $TiO_2$ to 0.94 mol/L. The resultant was subjected to a heat treatment at 90° C., followed by addition of a 10 N sodium hydroxide aqueous solution (560 mL) over 1 hour and then stirring at 95° C. for 1 hour, to obtain a slurry.

The obtained slurry was cooled to 50° C. Subsequently, 2N hydrochloric acid was added to the cooled slurry until the pH would reach 5.0, followed by stirring for 1 hour. The obtained precipitates were washed through decantation and were separated through filtration. The precipitates were dried in the atmosphere at 120° C. for 10 hours, to obtain strontium titanate powdery material A.

When the obtained strontium titanate powdery material A was analyzed through X-ray analysis of SEM-EDS, sodium silicate as the Si-containing particles was found to exist on the surface of the strontium titanate powdery material A, and also Si was found to exist even inside the strontium titanate powdery material A.

(Production of Strontium Titanate Powdery Material B)

Strontium titanate powdery material B was obtained in the same manner as in the above "Production of strontium titanate powdery material A" except that the amount of sodium silicate was changed from 0.15 mol to 0.29 mol.

When the obtained strontium titanate powdery material B was analyzed through X-ray analysis of SEM-EDS, sodium silicate as the Si-containing particles was found to exist on the surface of the strontium titanate powdery material B, and also Si was found to exist even inside the strontium titanate powdery material B.

(Production of Strontium Titanate Powdery Material C)

Strontium titanate powdery material C was obtained in the same manner as in the above "Production of strontium titanate powdery material A" except that the amount of sodium silicate was changed from 0.15 mol to 0.03 mol.

When the obtained strontium titanate powdery material C was analyzed through X-ray analysis of SEM-EDS, sodium silicate as the Si-containing particles was found to exist on the surface of the strontium titanate powdery material C, and also Si was found to exist even inside the strontium titanate powdery material C.

General Formula (1)

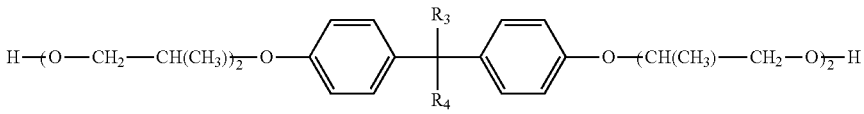

(Production of Strontium Titanate Powdery Material D)

Strontium titanate powdery material D was obtained in the same manner as in the above "Production of strontium titanate powdery material A" except that a 10 N sodium hydroxide aqueous solution (560 mL) was added over 18 hours.

When the obtained strontium titanate powdery material D was analyzed through X-ray analysis of SEM-EDS, sodium silicate as the Si-containing particles was found to exist on the surface of the strontium titanate powdery material D, and also Si was found to exist even inside the strontium titanate powdery material D.

(Production of Strontium Titanate Powdery Material E)

Strontium titanate powdery material E was obtained in the same manner as in the above "Production of strontium titanate powdery material A" except that the heat treatment was performed at 95° C. instead of 90° C., and a 10 N sodium hydroxide aqueous solution (560 mL) was added over 30 minutes.

When the obtained strontium titanate powdery material E was analyzed through X-ray analysis of SEM-EDS, sodium silicate as the Si-containing particles was found to exist on the surface of the strontium titanate powdery material E, and also Si was found to exist even inside the strontium titanate powdery material E.

(Production of Strontium Titanate Powdery Material F)

Strontium titanate powdery material F was obtained in the same manner as in the above "Production of strontium titanate powdery material A" except that the amount of sodium silicate was changed from 0.15 mol to 0.33 mol.

When the obtained strontium titanate powdery material F was analyzed through X-ray analysis of SEM-EDS, sodium silicate as the Si-containing particles was found to exist on the surface of the strontium titanate powdery material F, and also Si was found to exist even inside the strontium titanate powdery material F.

(Production of Strontium Titanate Powdery Material G)

Strontium titanate powdery material G was obtained in the same manner as in the above "Production of strontium titanate powdery material A" except that the amount of sodium silicate was changed from 0.15 mol to 0.04 mol and the heat treatment was performed at 80° C. instead of 90° C.

When the obtained strontium titanate powdery material G was analyzed through X-ray analysis of SEM-EDS, sodium silicate as the Si-containing particles was found to exist on the surface of the strontium titanate powdery material G, and also Si was found to exist even inside the strontium titanate powdery material G.

(Production of Strontium Titanate Powdery Material H)

Strontium titanate powdery material H was obtained in the same manner as in the above "Production of strontium titanate powdery material A" except that the amount of sodium silicate was changed from 0.15 mol to 0.27 mol and the heat treatment was performed at 95° C. instead of 90° C.

When the obtained strontium titanate powdery material H was analyzed through X-ray analysis of SEM-EDS, sodium silicate as the Si-containing particles was found to exist on the surface of the strontium titanate powdery material H, and also Si was found to exist even inside the strontium titanate powdery material H.

Example 1

[Toner Materials and Amounts Thereof]

Non-linear polyester resin A: 42 parts by mass

Linear polyester resin B: 45 parts by mass

Wax dispersant: 13 parts by mass

Carbon black: 10 parts by mass

Carnauba wax (obtained from TOA KASEI CO., LTD., WA-03): 3 parts by mass

The above toner materials in the above amounts were stirred and mixed using a HENSCHEL mixer. The mixture was heated at a temperature of from 125° C. through 130° C. for 40 minutes using a roll mill kneader, followed by cooling the mixture to room temperature (25° C.) to obtain a kneaded product. The obtained kneaded product was pulverized and classified using a jet mill to obtain toner base particles having a volume average particle diameter of 7.0 μm and a particle size distribution where particles having a particle diameter of 5.0 μm or less were 35% by number.

Then, silica (HDK-2000, obtained from Clariant (Japan) K.K.) (1.0 part by mass) and the strontium titanate powdery material A (0.7 parts by mass) were added to the toner base particles (100 parts by mass), followed by mixing using a HENSCHEL mixer under the following mixing conditions. Particles having a particle diameter of 35 μm or more were removed using a sieve to obtain toner A.

—Mixing Conditions—

Frequency: 80 Hz

Time: 10 min

Example 2

Toner B was obtained in the same manner as in Example 1 except that the strontium titanate powdery material A was changed to the strontium titanate powdery material B.

Example 3

Toner C was obtained in the same manner as in Example 1 except that the strontium titanate powdery material A was changed to the strontium titanate powdery material C.

Example 4

Toner D was obtained in the same manner as in Example 1 except that the strontium titanate powdery material A was changed to the strontium titanate powdery material D.

Example 5

Toner E was obtained in the same manner as in Example 1 except that the strontium titanate powdery material A was changed to the strontium titanate powdery material E.

Example 6

Toner F was obtained in the same manner as in Example 1 except that the strontium titanate powdery material A was changed to the strontium titanate powdery material F.

Example 7

Toner G was obtained in the same manner as in Example 1 except that the amount of the wax dispersant was changed from 13 parts by mass to 7 parts by mass.

Example 8

Toner H was obtained in the same manner as in Example 1 except that the roll mill kneader was changed to an open roll type kneader (obtained from NIPPON COKE & ENGINEERING Co., LTD.: KNEADEX MOS-100 model).

Example 9

Toner I was obtained in the same manner as in Example 1 except that the amount of the carnauba wax was changed from 3 parts by mass to 2.2 parts by mass.

Example 10

Toner J was obtained in the same manner as in Example 1 except that the amount of the carnauba wax was changed from 3 parts by mass to 5.4 parts by mass.

Comparative Example 1

Toner K was obtained in the same manner as in Example 1 except that the strontium titanate powdery material A was changed to the strontium titanate powdery material G.

Comparative Example 2

Toner L was obtained in the same manner as in Example 1 except that the strontium titanate powdery material A was changed to the strontium titanate powdery material H.

Comparative Example 3

Toner M was obtained in the same manner as in Example 1 except that the strontium titanate powdery material A was changed to SW-100 (obtained from Titan Kogyo, Ltd., strontium titanate powdery material I).

Each of the obtained toners was measured for characteristics in the following manners. Results are presented in Table 1.

<Measurements of Number Average Circle Equivalent Diameter of Primary Particles of Strontium Titanate Powdery Material and Number Average Circle Equivalent Diameter of Si-Containing Particles>

The scanning electron microscope (SU8200 series, obtained from Hitachi High-Technologies Corporation) was used to obtain a toner image of each of the toners A to N. The obtained toner image was binarized using image processing software "A-zokun" (obtained from Asahi Kasei Engineering Corporation) to calculate a circle equivalent diameter. The calculation of the above circle equivalent diameter was as follows.

The volume of the particle was calculated from the "circle equivalent diameter 2" obtained by the particle analysis mode of the image processing software "A-zokun". Based on the following formula (1), the number average circle equivalent diameter was calculated.

Number average circle equivalent diameter (nm)= [the sum of the values of (circle equivalent diameter×volume) of the measured particles]/the sum of volumes of the measured particles] Formula (1)

Details of the analysis conditions in the present analysis will be described below.

Binarization method (threshold value): manual setting (visual observation)

Range designation: done

Outer edge correction: not done

Filling holes: done

Erosion separation: not done

In the case of an image where toner particles were overlapped, a threshold value was manually set in the above process to distinguish concave/convex portions on the surface of the toner from the external additive. At the time of the binarization, when a significant change in contrast was found in the same image, the analysis range was designated to the vicinity of one particle. Then, only regions in and around the one particle were observed to set the threshold value.

<Measurement of Circle Equivalent Diameter of Wax>

Each toner was embedded in an epoxy resin, and a microtome was used to cut out a cross section of the toner, followed by ruthenium staining. Using the scanning electron microscope (SEM (cold) Hitachi SU8230, obtained from Hitachi High-Technologies Corporation), the cross section of the toner was observed at a magnification of ×5,000. A backscattered electron image obtained using the image processing software "A-zokun" was input with a scale unit of μm, and a part of the particle stained with ruthenium was analyzed (binarized) to calculate the circle equivalent diameter. The cross section of the toner may or may not pass through the center of the toner.

<Measurement Method of Peak Intensity Ratio (W/R)>

Load (1 t) was applied to the toner (2.0 g) for 60 seconds, and a pellet having a diameter of 20 mm was molded by the application of pressure so as to obtain a smooth surface. An absorbance spectrum was obtained by the attenuated total reflectance (ATR) method using a Fourier transform infrared (FT-IR) spectroscopy analysis measuring apparatus, Avatar 370, obtained from ThermoElectron. The peak intensity ratio (W/R) was calculated, where W was absorbance of a peak of the absorbance spectrum that was derived from C—H stretching of an alkyl chain of the release agent (wax) and R was absorbance of a peak of the absorbance spectrum of the resin.

When the toner contained two or more different resins and two or more different peaks were detected, absorbance of the highest peak from a baseline of the spectrum was considered as R. For example, when the toner contained a polyester resin (the peak observed in the range of from 784 $cm^{-1}$ through 889 $cm^{-1}$; see FIG. 2) and a styrene-acrylic copolymer resin (the peak observed in the range of from 670 $cm^{-1}$ through 714 $cm^{-1}$) and absorbance of the peak observed in the range of from 784 $cm^{-1}$ through 889 $cm^{-1}$ was higher, the absorbance of the peak observed in the range of from 784 $cm^{-1}$ through 889 $cm^{-1}$ was considered as R.

<Measurement Method of Molar Ratio (Si/Ti) of Si to Ti in Strontium Titanate Powdery Material>

Using X-ray analysis of SEM-EDS, the molar ratio (Si/Ti) of Si to Ti in the strontium titanate powdery material was measured from the ratio of the peak intensity of Si to the peak intensity of Ti in the strontium titanate powdery material, with the peak intensity of carbon being a standard.

<Measurement Method of BET Specific Surface Area>

Using GEMINI 2375 (obtained from MICROMETORICS INSTRUMENT CO.), 40 samples were measured for an adsorption amount of nitrogen gas while a relative pressure was gradually increased in the range of the relative pressure of 0.02 or more but 1.00 or less, to prepare nitrogen adsorption amount isotherms of the samples. Results of the 40 samples were plotted for BET, followed by determining the BET specific surface area per weight ($m^2$/g.

<Evaluations>

A developer obtained by mixing each (5% by mass) of the toners A to N and a manganese-magnesium ferrite carrier (95% by mass) covered with a silicone resin and having an average particle diameter of 40 μm was used to evaluate fog, photoconductor abrasion, and image density in the following manners.

<Evaluation of Fog>

Each of the toners A to N and the carrier were used for developing using a modified machine of a copier (IMAGIO MF7070, obtained from Ricoh Company, Ltd.). An image with an image area of 5% was formed in a low-humidity environment (temperature: 10° C. and humidity: 15% RH) at 5,000 sheets/day. After the image was formed on the first sheet of paper and after the image was formed on the 100,000th sheet of paper, white solid images and black solid images were each printed on three sheets of A3-sized paper (product name: RICOH MYPAPER). Fog on the obtained white solid images on the first sheet of paper and on the 100,000th sheet of paper was visually observed. In comparison with the white solid images on the first sheet of paper, the white solid image on the 100,000th sheet of paper was evaluated based on the following evaluation criteria for fog. Results are presented in Table 1.

[Evaluation Criteria of Fog]

A: No fog was found at all; very good.

B: Almost no fog was found; good.

C: Fog was found; bad.

<Evaluation of Photoconductor Abrasion>

A microscope (VHX-6000, obtained from KEYENCE CORPORATION) was used to obtain three-dimensional (3D) data from a 3D image connection. Concave/convex portions on the entire surface of the photoconductor (i.e., abrasion amount of a photoconductor) were measured before and after an image was formed on 100,000 sheets of paper. The abrasion amount of the photoconductor was evaluated based on the following evaluation criteria of the photoconductor abrasion. Results are presented in Table 1.

The abrasion amount of a photoconductor means the thickness of the photoconductor reduced after formation of the images as compared to the thickness of the photoconductor before formation of the images.

[Evaluation Criteria of Photoconductor Abrasion]

A: The abrasion amount of the photoconductor was 2 μm or less.

B: The abrasion amount of the photoconductor was more than 2 μm but less than 3 μm.

C: The abrasion amount of the photoconductor was 3 μm or more.

TABLE 1

| | | Inorganic particles | | | | | | | Evaluations | |
|---|---|---|---|---|---|---|---|---|---|---|
| | Toner name | Name | Number average circle equivalent diameter (nm) of primary particles of strontium titanate powdery material | Molar ratio of Si to Ti | BET specific surface area ($m^2/g$) of strontium titanate powdery material | Number average circle equivalent diameter (nm) of Si-containing particles | Circle equivalent diameter (μm) of wax | Peak intensity ratio (W/R) | Fog | Photo-conductor abrasion |
| Ex. 1 | A | Strontium titanate powdery material A | 35 | 5.1 | 72 | 9.3 | 0.3 | 0.08 | A | A |
| Ex. 2 | B | Strontium titanate powdery material B | 36 | 9.7 | 69 | 10.5 | 0.3 | 0.08 | B | A |
| Ex. 3 | C | Strontium titanate powdery material C | 33 | 1.1 | 82 | 8.2 | 0.3 | 0.08 | A | B |
| Ex. 4 | D | Strontium titanate powdery material D | 42 | 4.9 | 56 | 9.6 | 0.3 | 0.08 | B | B |
| Ex. 5 | E | Strontium titanate powdery material E | 17 | 5.0 | 98 | 8.4 | 0.3 | 0.08 | B | B |
| Ex. 6 | F | Strontium titanate powdery material F | 38 | 11.1 | 63 | 12.8 | 0.3 | 0.08 | B | B |
| Ex. 7 | G | Strontium titanate powdery material A | 35 | 5.1 | 72 | 9.3 | 0.7 | 0.08 | B | B |
| Ex. 8 | H | Strontium titanate powdery material A | 35 | 5.1 | 72 | 9.3 | 0.05 | 0.07 | B | B |
| Ex. 9 | I | Strontium titanate powdery material A | 35 | 5.1 | 72 | 9.3 | 0.1 | 0.04 | B | B |
| Ex. 10 | J | Strontium titanate powdery material A | 35 | 5.1 | 72 | 9.3 | 0.5 | 0.16 | B | B |
| Comp. Ex. 1 | K | Strontium titanate powdery material G | 38 | 1.7 | 52 | 17.2 | 0.3 | 0.08 | C | B |
| Comp. Ex. 2 | L | Strontium titanate powdery material H | 31 | 8.8 | 123 | 4.3 | 0.3 | 0.08 | B | C |
| Comp. Ex. 3 | M | Strontium titanate powdery material I | 33 | — | 21 | 0 | 0.3 | 0.08 | C | C |

Aspects of the present disclosure are as follows, for example.

<1> A toner including a strontium titanate powdery material as an external additive, the strontium titanate powdery material including Si-containing particles on a surface of the strontium titanate powdery material, the Si-containing particles having a number average circle equivalent diameter of 5 nm or more but 15 nm or less.

<2> The toner according to <1>, wherein primary particles of the strontium titanate powdery material have a number average circle equivalent diameter of 20 nm or more but 40 nm or less and a BET specific surface area of 50 $m^2/g$ or more.

<3> The toner according to <1> or <2>, wherein a molar ratio (Si/Ti) of Si to Ti in the strontium titanate powdery material is 1.0 or more but 10.0 or less.

<4> The toner according to any one of <1> to <3>, wherein the molar ratio (Si/Ti) of Si to Ti in the strontium titanate powdery material is 2.0 or more but 9.0 or less.

<5> The toner according to any one of <1> to <4>, further including an ester wax, wherein a circle equivalent diameter of the wax in a cross section of the toner is 0.1 μm or more but 0.5 μm or less.

<6> The toner according to <5>, further including a resin, wherein the toner has a peak intensity ratio (W/R) of 0.05 or more but 0.14 or less, where the W is maximum height of a characteristic peak of the wax and the R is maximum height of a characteristic peak of the resin as measured by an attenuated total reflectance (ATR) method using a Fourier transform infrared spectroscopy (FT-IR) analysis measuring apparatus.

<7> A toner stored container including:

the toner according to any one of <1> to <6>; and a container, the toner being stored in the container.

<8> A developer including:

the toner according to any one of <1> to <6>; and a carrier.

<9> A developing device including:

the developer according to <8>; and a developer bearer configured to bear and convey the developer.

<10> A process cartridge including:

an electrostatic latent image bearer; and a developing unit containing the developer according to <8>, configured to develop, with the developer, an electrostatic latent image formed on the electrostatic latent image bearer.

<11> An image forming apparatus including:

an electrostatic latent image bearer; and a developing unit containing the developer according to <8>, configured to develop, with the developer, an electrostatic latent image formed on the electrostatic latent image bearer.

The toner according to any one of <1> to <6>, the toner stored container according to <7>, the developer according to <8>, the developing device according to <9>, the process cartridge according to <10>, and the image forming apparatus according to <11> can solve the conventionally existing problems and can achieve the object of the present disclosure.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A toner comprising a strontium titanate powdery material as an external additive, the strontium titanate powdery material comprising primary particles of strontium titanate wherein the primary particles comprise Si-containing particles inside of and on a surface of the primary particles, the Si-containing particles having a number average circle equivalent diameter of 5 nm or more but 15 nm or less.

2. The toner according to claim 1, wherein primary particles of the strontium titanate powdery material have a number average circle equivalent diameter of 20 nm or more but 40 nm or less and a BET specific surface area of 50 $m^2/g$ or more.

3. The toner according to claim 1, wherein a molar ratio (Si/Ti) of Si to Ti in the strontium titanate powdery material is 1.0 or more but 10.0 or less.

4. The toner according to claim 1, further comprising a wax containing an ester wax, wherein a circle equivalent diameter of the wax in a cross section of the toner is 0.1 μm or more but 0.5 μm or less.

5. A toner stored container comprising:

the toner according to claim 1; and a container, the toner being stored in the container.

6. A developer comprising:

the toner according to claim 1; and a carrier.

7. A developing device comprising:

the developer according to claim 6; and a developer bearer configured to bear and convey the developer.

8. A process cartridge comprising:

an electrostatic latent image bearer; and a developing unit containing the developer according to claim 6, configured to develop, with the developer, an electrostatic latent image formed on the electrostatic latent image bearer.

9. An image forming apparatus comprising:

an electrostatic latent image bearer; and a developing unit containing the developer according to claim 6, configured to develop, with the developer, an electrostatic latent image formed on the electrostatic latent image bearer.

10. The toner according to claim 1, wherein the Si-containing particles having a number average circle equivalent diameter of 8 to 10 nm.

11. The toner according to claim 1, wherein the Si to Ti in the strontium titanate powdery material is in a molar ratio Si/Ti of 1.0 to 10.0.

12. The toner according to claim 1, wherein the Si to Ti in the strontium titanate powdery material is in a molar ratio Si/Ti of 4.0 to 6.0.

13. The toner according to claim 1, wherein the strontium titanate powdery material is present in an amount of 0.4 to 4.0 parts by mass.

14. The toner according to claim 1, further comprising a resin and wherein the toner has a peak intensity ratio (W/R)

of 0.05 or more but 0.14 or less, where the W is maximum height of a characteristic peak of the wax and the R is maximum height of a characteristic peak of the resin as measured by an attenuated total reflectance (ATR) method using a Fourier transform infrared spectroscopy (FT-IR) analysis measuring apparatus.

15. The toner according to claim 1, further comprising a resin.

16. A toner according to claim 1, wherein the Si-containing particles comprise sodium silicate or silica.

17. A toner according to claim 1, wherein the strontium titanate powdery material is made by a process comprising mixing a peptized product of mineral acid as a source of Ti and a water-soluble compound as a source of Sr, following by further mixing with a material for the Si-containing particles.

* * * * *